US011185885B2

(12) United States Patent
Ono et al.

(10) Patent No.: US 11,185,885 B2
(45) Date of Patent: Nov. 30, 2021

(54) METHOD FOR FORMING MULTILAYER COATING FILM

(71) Applicant: KANSAI PAINT CO., LTD., Hyogo (JP)

(72) Inventors: Ikumi Ono, Kanagawa (JP); Nobuhiko Narita, Kanagawa (JP); Hirokazu Okazaki, Kanagawa (JP)

(73) Assignee: KANSAI PAINT CO., LTD., Hyogo (JP)

( * ) Notice: Subject to any disclaimer, the term of this patent is extended or adjusted under 35 U.S.C. 154(b) by 0 days.

(21) Appl. No.: 16/758,894

(22) PCT Filed: Oct. 31, 2018

(86) PCT No.: PCT/JP2018/040584
§ 371 (c)(1),
(2) Date: Apr. 24, 2020

(87) PCT Pub. No.: WO2019/088201
PCT Pub. Date: May 9, 2019

(65) Prior Publication Data

US 2021/0178428 A1 Jun. 17, 2021

(30) Foreign Application Priority Data

Nov. 1, 2017 (JP) ..... JP2017-212158

(51) Int. Cl.
*B05D 5/06* (2006.01)
*B05D 7/14* (2006.01)
*B05D 7/00* (2006.01)

(52) U.S. Cl.
CPC ..... *B05D 5/068* (2013.01); *B05D 7/14* (2013.01); *B05D 7/57* (2013.01); *B05D 2401/20* (2013.01); *B05D 2420/01* (2013.01); *B05D 2420/02* (2013.01); *B05D 2420/03* (2013.01); *B05D 2601/08* (2013.01); *B05D 2602/00* (2013.01)

(58) Field of Classification Search
CPC . B05D 5/068; B05D 7/14; B05D 7/57; B05D 2401/20; B05D 2420/01; B05D 2420/02
See application file for complete search history.

(56) References Cited

U.S. PATENT DOCUMENTS

| | | | | |
|---|---|---|---|---|
| 4,981,759 | A * | 1/1991 | Nakatani | C09D 5/4473 428/626 |
| 6,652,919 | B1 * | 11/2003 | Campbell | B05D 7/574 427/379 |
| 8,993,673 | B2 * | 3/2015 | Kitagawa | C08G 18/6659 524/507 |
| 2014/0255608 | A1 | 9/2014 | Eibon et al. | |
| 2015/0217332 | A1 | 8/2015 | Fujii et al. | |
| 2015/0218405 | A1 * | 8/2015 | Iwata | C09D 133/066 428/423.1 |
| 2016/0288164 | A1 | 10/2016 | Sato et al. | |
| 2017/0291401 | A1 | 10/2017 | Yamane et al. | |
| 2018/0214912 | A1 | 8/2018 | Itoh et al. | |

FOREIGN PATENT DOCUMENTS

| | | |
|---|---|---|
| DE | 11 2013 004 277 | 5/2015 |
| GB | 2548262 | 9/2017 |
| JP | 2002-86057 | 3/2002 |
| JP | 2007-167720 | 7/2007 |
| JP | 2012-232236 | 11/2012 |
| JP | 2016-77998 | 5/2016 |
| WO | 2016/088295 | 6/2016 |
| WO | 2017/022698 | 2/2017 |
| WO | 2017/111112 | 6/2017 |

OTHER PUBLICATIONS

International Search Report dated Jan. 29, 2019 in International (PCT) Application No. PCT/JP2018/040584.
Extended European Search Report dated Jul. 19, 2021 in corresponding European Patent Application No. 18872232.6.

* cited by examiner

*Primary Examiner* — Dah-Wei D. Yuan
*Assistant Examiner* — Kristen A Dagenais-Englehart
(74) *Attorney, Agent, or Firm* — Wenderoth, Lind & Ponack, L.L.P.

(57) ABSTRACT

A method for forming a multilayer coating film comprising the steps of:

applying, to a substrate, an effect pigment dispersion that comprises water, a surface adjusting agent, a flake-effect pigment, and a rheology control agent, and that has a solids content within the range of 0.5 to 10 mass % to form an effect pigment-containing coating film; and applying a colored transparent paint to the effect pigment-containing coating film to form a colored transparent coating film having a total light transmittance at a wavelength of 400 nm to 700 nm of 20 to 70%.

4 Claims, No Drawings

METHOD FOR FORMING MULTILAYER COATING FILM

TECHNICAL FIELD

The present invention relates to a method for forming a multilayer coating film.

BACKGROUND ART

Metallic paint colors, which have high lightness in highlight (near-specular reflection light) and changes in lightness from highlight to bottom (in the oblique direction), have become popular as paint colors applied to the exterior of industrial products such as automobiles. Among metallic paint colors, those having high chroma in highlight have been attracting attention due to their high noticeability.

As a method for obtaining a paint color that has high lightness and high chroma in highlight, and that has a significant difference in lightness from bottom, PTL 1 discloses a coating film formation method comprising applying a first color clear paint to a metallic base coating film obtained by applying a metallic base paint containing a color pigment and a flake-effect pigment; and then applying a second color clear paint to the obtained first color clear coating film. However, the coating film obtained by the method of PTL 1 may have insufficient lightness in highlight, and an insufficient change in lightness from highlight to bottom depending on the orientation of the flake-effect pigment in the metallic base coating film. Thus, PTL 1 has problems such as high lightness in its entirety, and insufficient darkness.

CITATION LIST

Patent Literature

PTL JP2012-232236A

SUMMARY OF INVENTION

Technical Problem

The present invention aims to provide a method for forming a multilayer coating film that can obtain a paint color having high lightness and high chromes, low graininess, high flip-flop property, and excellent darkness in highlight (near-specular reflection light).

Solution to Problem

The present invention encompasses the subject matter described in the following items.

Item 1.

A method for forming a multilayer coating film comprising the steps of:

applying, to a substrate, an effect pigment dispersion that comprises water, a surface adjusting agent, a flake-effect pigment, and a rheology control agent, and that has a solids content within the range of 0.5 to 10 mass % to form an effect pigment-containing coating film; and applying a colored transparent paint to the effect pigment-containing coating film to form a colored transparent coating film having a total light transmittance at a wavelength of 400 nm to 700 nm of 20 to 70%.

Item 2.

The method for forming a multilayer coating film according to Item 1, further comprising a step of applying a top clear paint to the colored transparent coating film to form a top clear coating film.

Item 3.

The method for forming a multilayer coating film according to Item 1 or 2, wherein the flake-effect pigment in the effect pigment dispersion is a vapor deposition metal flake pigment.

Item 4.

The method for forming a multilayer coating film according to any one of Items 1 to 3, wherein the effect pigment dispersion further comprises a color pigment.

Item 5.

The method for forming a multilayer coating film according to any one of Items 1 to 4, wherein the rheology control agent in the effect pigment dispersion is a cellulose nanofiber.

Advantageous Effects of Invention

According to the method for forming a multilayer coating film of the present invention, a paint color having high lightness and high chroma, low graininess, high flip-flop property, and excellent darkness in highlight (near-specular reflection light) can be obtained.

DESCRIPTION OF EMBODIMENTS

The method for forming a multilayer coating film according to the present invention is further explained in detail below.

The method for forming a multilayer coating film according to the present invention comprises the steps of applying an effect pigment dispersion to form an effect pigment-containing coating film, and applying a colored transparent paint to the effect pigment-containing coating film to form a colored transparent coating film having a total light transmittance at a wavelength of 400 nm to 700 nm of 20 to 70%.

The method for forming a multilayer coating film according to the present invention is not limited to the method consisting of the steps of individually forming the above two layers. For example, the method may further comprise the step of applying a top clear paint to the colored transparent coating film to form a top clear coating film.

Alternatively, a clear paint may be applied to the effect pigment-containing coating film to form a clear coating film, and then a colored transparent paint may be applied to the clear coating film to form a colored transparent coating film.

Thus, the method for forming a multilayer coating film according to the present invention encompasses multiple embodiments, as long as the method comprises the step of forming an effect pigment-containing coating film and the step of forming a colored transparent coating film. Each embodiment is detailed below.

The first embodiment is a 6C3B process. The 6C3B process is a process that comprises forming a six-layered coating film by coating, and performing bake-drying three times. The method for forming a multilayer coating film according to the 6C3B process in the present invention specifically includes applying an intermediate paint to a substrate, followed by heating, to form an intermediate coating film; applying a base paint to the formed intermediate coating film to form an uncured base coating film; applying an effect pigment dispersion to the formed uncured base coating film to form an uncured effect pigment-containing coating film; applying a clear paint to the formed uncured effect pigment containing coating film to form an uncured clear coating film; heating the formed uncured base coating film, uncured effect pigment-containing coating film, and uncured clear coating film to simultaneously cure these three coating films; applying a colored transparent paint to the obtained multilayer coating film to form an uncured colored transparent coating film having a total light transmittance at a wavelength of 400 nm to 700 nm of 20 to 70%; applying a top clear paint to the formed uncured colored transparent coating film to form an uncured top clear coating film; and heating the formed uncured colored transparent coating film and the uncured top clear coating film to simultaneously cure these coating films.

The second embodiment is a 4C2B process. The 4C2B process is a process that comprises forming a four-layered coating film by coating, and performing bake-drying two times. The method for forming a multilayer coating film according to the 4C2B process in the present invention specifically includes applying an intermediate paint to a substrate, followed by heating, to form an intermediate coating film; applying a base paint to the formed intermediate coating film to form an uncured base coating film; applying an effect pigment dispersion to the formed uncured base coating film to form an uncured effect pigment-containing coating film; applying a colored transparent paint to the formed uncured effect pigment-containing coating film to form an uncured colored transparent coating film having a total light transmittance at a wavelength of 400 nm to 700 nm of 20 to 70%; and heating the formed uncured base coating film, uncured effect pigment-containing coating film, and uncured colored transparent coating film to simultaneously cure these three coating films.

The third embodiment is a 5C3B process. The 5C3B process is a process that comprises forming a five-layered coating film by coating, and performing bake-drying three times. The 5C3B process according to the present embodiment is a 5C3B double-clear process because two clear coating films, i.e., a colored transparent coating film, which is a color clear coating film, and a top clear coating film, are layered. The 5C3B coating process in the method for forming a multilayer coating film of the present invention specifically includes applying an intermediate paint to a substrate, followed by heating, to form an intermediate coating film; applying a base paint to the formed intermediate coating film to form an uncured base coating film; applying an effect pigment dispersion to the formed uncured base coating film to form an uncured effect pigment-containing coating film; applying a colored transparent paint to the formed uncured effect pigment-containing coating film to form an uncured colored transparent coating film having a total light transmittance at a wavelength of 400 nm to 700 nm of 20 to 70%; heating the formed uncured base coating film, uncured effect pigment-containing coating film, and uncured colored transparent coating film to cure these coating films; applying a top clear paint to the obtained multilayer coating film to form a top clear coating film; and heating the top clear coating film to cure the top clear coating film.

The fourth embodiment is a 5C2B coating process. The 5C2B process is a process that comprises forming a five-layered coating film by coating, and performing bake-drying two times. The 5C2B coating process in the method for forming a multilayer coating film of the present invention specifically includes applying an intermediate paint to a substrate to form an uncured intermediate coating film; applying an effect pigment dispersion to the formed uncured intermediate coating film to form an uncured effect pigment-containing coating film; applying a clear paint to the formed uncured effect pigment-containing coating film to form an uncured clear coating film; heating the formed uncured base coating film, uncured effect pigment-containing coating film, and uncured clear coating film to simultaneously cure these three coating films; applying a colored transparent paint to the obtained multilayer coating film to form an uncured colored transparent coating film having a total light transmittance at a wavelength of 400 nm to 700 nm of 20 to 70%; applying a top clear paint to the formed uncured colored transparent coating film to form a top clear coating film; and heating the formed uncured colored transparent coating film and top clear coating film to cure these coating films.

The fifth embodiment is a 3C1B coating process. The 3C1B coating process is a process that comprises forming a three-layered coating film by coating, and performing bake-drying once. The 3C1B coating process in the method for forming a multilayer coating film of the present invention includes applying an intermediate paint to a substrate to form an uncured intermediate coating film; applying an effect pigment dispersion to the formed uncured intermediate coating film to form an effect pigment-containing coating film; applying a colored transparent paint to the formed uncured effect pigment-containing coating film to form an uncured colored transparent coating film having a total light transmittance at a wavelength of 400 nm to 700 nm of 20 to 70%; and heating the formed uncured base coating film, uncured effect pigment-containing coating film, and uncured colored transparent coating film to simultaneously cure these three coating films.

The sixth embodiment is a 4C2B process. The 4C2B process in the present embodiment is a process comprising forming a four-layered coating film by coating, and performing bake-drying two times. The 4C2B process is a 4C2B double-clear process because two clear coating films, i.e., a colored transparent coating film, which is a color clear coating film, and a top clear coating film are laminated. The 4C2B double-clear process in the method for forming a multilayer coating film of the present invention specifically includes applying an intermediate paint to a substrate to form an uncured intermediate coating film; applying an effect pigment dispersion to the formed uncured intermediate coating film to form an uncured effect pigment-containing coating film; applying a colored transparent paint to the formed uncured effect pigment-containing coating film to form an uncured colored transparent coating film having a total light transmittance at a wavelength of 400 nm to 700 nm of 20 to 70%; heating the formed uncured intermediate coating film, uncured effect pigment-containing coating film, and uncured colored transparent coating film to cure these coating films, thus obtaining a multilayer coating film; applying a top clear paint to the multilayer coating film to obtain a top clear coating film; and heating the top clear coating film to cure the top clear coating film.

Substrate

The substrate to which the method of the present invention can be applied is not particularly limited. Examples include exterior panels of vehicle bodies, such as automobiles, trucks, motorcycles, and buses; automobile components; and exterior panels of home appliances, such as mobile phones, audio equipment, or the like. Among these, vehicle body exterior panels and automobile components are preferable.

The base materials that constitute these substrates are not particularly limited. Examples include metal plates, such as iron plates, aluminum plates, brass plates, copper plates, stainless steel plates, tin plates, galvanized steel plates, and alloyed zinc (Zn—Al, Zn—Ni, Zn—Fe, and the like)-plated steel plates; resins, such as polyethylene resin, polypropylene resin, acrylonitrile-butadiene-styrene (ABS) resin, polyamide resin, acrylic resin, vinylidene chloride resin, polycarbonate resin, polyurethane resin, and epoxy resin; plastic materials, such as various FRPs; inorganic materials, such as glass, cement, and concrete; wood; fibrous materials (paper, cloth, and the like); and the like. Among these, molded articles or films made of metal plates or plastic materials are preferable.

Moreover, the above substrate may be one in which an undercoating film is formed on a base material mentioned above. When the base material is made of metal, chemical conversion treatment using phosphate, chromate, and the like is preferably performed before an undercoating film is formed.

The undercoating film is formed for the purpose of imparting, for example, anticorrosion, antirust, adhesion to the base material, and masking properties for the unevenness of the base material surface. As undercoating paints for forming such undercoating films, those that are themselves known can be used. For example, cationic or anionic electrodeposition paints are preferably applied to conductive base materials, such as metals. Chlorinated polyolefin resin-based paints are preferably applied to low-polarity base materials, such as polypropylene.

After the application, the undercoating paint may be cured by heating, blowing, or like means; or may be dried to an extent that does not cause curing. When a cationic or anionic electrodeposition paint is used as the undercoating paint, the undercoating film is preferably cured by heating after the application of the undercoating paint so as to prevent the formation of a mixed layer between the undercoating film and a coating film sequentially formed on the undercoating film, and to form a multilayer coating film of excellent appearance.

Intermediate Paint

The intermediate paint is used to ensure surface smoothness of the coating film, and to strengthen coating film properties, such as impact resistance and chipping resistance. The "chipping resistance" mentioned herein is tolerance to damage to coating films caused by collision of obstructions, such as small stones.

The intermediate paint used in this step is preferably a thermosetting paint that is commonly used in this field, and that contains a base resin, a curing agent, and a medium comprising water and/or an organic solvent.

As the base resin and the curing agent, known compounds commonly used in this field can be used. Examples of the base resin include acrylic resins, polyester resins, epoxy resins, polyurethane resins, and the like. Examples of the curing agent include amino resins, polyisocyanate compounds, blocked polyisocyanate compounds, and the like. Usable examples of the hydrophilic organic solvent include methanol, ethanol, n-propyl alcohol, isopropyl alcohol, ethylene glycol, and the like.

In addition to the above components, the intermediate paint used in the method for forming a multilayer coating film according to the present invention may suitably contain, if necessary, an ultraviolet absorber, an antifoaming agent, a thickener, a rust inhibitor, a surface adjusting agent, a pigment, and the like.

Examples of the pigment include color pigments, extender pigments, effect pigments, and the like. These can be used singly or in a combination of two or more.

When the intermediate paint contains a pigment, the content of the pigment is preferably within the range of 1 to 500 parts by mass, more preferably 3 to 400 parts by mass, and even more preferably 5 to 300 parts by mass, based on 100 parts by mass of the total resin solids content in the intermediate paint. In particular, it is preferable that the intermediate paint contains a color pigment and/or an extender pigment, and that the total content of the color pigment and the extender pigment is preferably within the range of 1 to 500 parts by mass, more preferably 3 to 400 parts by mass, and even more preferably 5 to 300 parts by mass, based on 100 parts by mass of the total resin solids content in the intermediate paint.

Examples of the color pigments include titanium oxide, zinc flower, carbon black, molybdenum red, Prussian blue, cobalt blue, azo pigments, phthalocyanine pigments, quinacridone pigments, isoindoline pigments, threne pigments, perylene pigments, dioxazine pigments, diketopyrrolopyrrole pigments, and the like. Among these, titanium oxide and carbon black can be preferably used.

Examples of the extender pigments include clay, kaolin, barium sulfate, barium carbonate, calcium carbonate, talc, silica, alumina white, and the like. Among these, barium sulfate and/or talc are preferably used. In particular, it is preferable to use barium sulfate with an average primary particle size of 1 μm or less, and more preferably 0.01 to 0.8 μm, as the extender pigment, from the viewpoint of obtaining a multilayer coating film having an appearance with excellent smoothness.

In the present specification, the average primary particle size of barium sulfate is determined by observing barium sulfate using a scanning electron microscope, and averaging the maximum diameter of 20 barium sulfate particles on a straight line drawn at random on the electron microscope photograph.

When the intermediate paint contains an extender pigment mentioned above, the content of the extender pigment is preferably within the range of 1 to 300 parts by mass, more preferably 5 to 250 parts by mass, and even more preferably 10 to 200 parts by mass, based on 100 parts by mass of the total resin solids content in the intermediate paint.

Moreover, examples of the effect pigments include aluminum (including vapor-deposited aluminum), copper, zinc, brass, nickel, aluminum oxide, mica, titanium oxide- or iron oxide-coated aluminum oxide, titanium oxide- or iron oxide-coated mica, glass flakes, and holographic pigments. These effect pigments can be used singly or in a combination of two or more. Examples of aluminum pigments include non-leafing aluminum pigments and leafing aluminum pigments. Any of these pigments can be used.

When the intermediate paint contains an effect pigment mentioned above, the content of the effect pigment is preferably within the range of 0.1 to 50 parts by mass, more preferably 0.2 to 30 parts by mass, and even more preferably 0.3 to 20 parts by mass, based on 100 parts by mass of the total resin solids content in the intermediate paint. Coating of the intermediate paint having the above structure can improve the surface smoothness, impact resistance, and chipping resistance of the coated article.

As the coating method of the intermediate paint, general coating methods commonly used in this field can be used. Examples of the coating method include coating methods using a brush or a coating device. Among these, a coating method using a coating device is preferable. Preferable examples of the coating device include an airless spray coating device, an air spray coating device, and a rotary atomization electrostatic coating device; a rotary atomization electrostatic coating device is particularly preferable.

When a base coating film is laminated, the intermediate coating film obtained by coating the intermediate paint is preferably a dried coating film obtained by applying the intermediate paint, followed by heating for curing, in terms of preventing the formation of a mixed layer between the intermediate coating film and the base coating film. In this case, the heating temperature is preferably within the range of 110 to 180° C., and particularly preferably 120 to 160° C. The heat treatment time is preferably within the range of 10 to 60 minutes, and particularly preferably 15 to 40 minutes.

The cured film thickness of the intermediate coating film after heat treatment under the above conditions is preferably within the range of 10 to 50 μm, and particularly preferably 15 to 40 μm, in terms of the impact resistance and chipping resistance of the coating film.

The monochrome hiding film thickness of the intermediate paint is preferably 40 μm or less, more preferably 35 μm or less, and even more preferably 30 μm or less, in terms of the color stability of the multilayer coating film to be obtained. In the present specification, the "monochrome hiding film thickness" is a value obtained in the following manner. The monochrome checkered hiding power test paper specified in 4.1.2 of JIS K5600-4-1 is attached to a steel plate. Then, the paint is applied by inclined coating so that the film thickness continuously varies, and the paint is dried or cured. The coating surface is then visually observed under diffused daylight, and the minimum film thickness in which the monochrome border of the checker of the hiding power test paper disappears is measured by an electromagnetic film thickness meter. The measured value is determined as the "monochrome hiding film thickness."

After heat treatment, when the intermediate coating film has coating film defect portions, such as dirt, seed, and orange peel, these can be removed. These coating defect portions can be removed by grinding the coating film with abrasive paper or an abrasive cloth by hand, or using an instrument (sander) to which abrasive paper or an abrasive cloth is attached. Specifically, for example, the coating defect portions are first ground and removed using abrasive paper or an abrasive cloth containing a polishing material with a relatively rough particle size of about #400 to #600, and the ground surface is then made smooth using abrasive paper or an abrasive cloth containing a polishing material with a fine particle size of about #1000 to #1500. This is preferable to make the finished appearance of the multilayer coating film excellent. In order to remove coating film powder generated by grinding, it is preferable to wipe the coating surface with an organic solvent, such as gasoline, and to simultaneously perform degreasing. Grinding can be performed in the "spot range," that is, only in the above coating defect portions and neighboring portions thereof in the intermediate coating film; alternatively, the entire intermediate coating film can also be polished. Moreover, the grinding depth can be suitably selected according to the size, degree, and the like of dirt and seed; and is preferably within 50 μm, and more preferably about 10 to 30 μm.

When an effect pigment dispersion described below is directly applied to the intermediate coating film obtained by application of the intermediate paint, the effect pigment dispersion can be applied to the uncured intermediate coating film, without heating and curing the uncured intermediate coating film that is obtained by applying the intermediate paint. The uncured intermediate coating film is not limited to the coating film immediately after the application of the intermediate paint, but includes coating films that are allowed to stand at room temperature for 15 to 30 minutes, and coating films that are heated at 50 to 100° C. for 30 seconds to 10 minutes after the application of the intermediate paint.

Base Paint

In the method for forming a multilayer coating film according to the present invention, a base paint can be applied to the intermediate coating film to form a base coating film. As the base paint, a paint composition that is known itself can be used. In particular, a paint composition generally used for coating of vehicle bodies is suitably used.

The base paint is preferably a paint containing a base resin, a curing agent, and a medium comprising water and/or an organic solvent. As the base resin and the curing agent, known compounds commonly used in this field can be used.

The base resin is preferably a resin that has excellent weather resistance, transparency, and the like. Specific examples include acrylic resins, polyester resins, epoxy resins, urethane resins, and the like.

Examples of the acrylic resins include resins obtained by copolymerizing monomer components, such as α, β-ethylenically unsaturated carboxylic acids, (meth)acrylic acid esters having a functional group, such as a hydroxyl group, an amide group, or a methylol group, other (meth)acrylic-acid esters, and styrene.

Usable examples of polyester resins include those obtained by the condensation reaction of polybasic acid, polyhydric alcohol, or denatured oil by a conventional method.

Epoxy resins are not particularly limited, and known epoxy resins can be used. Examples include aromatic epoxy resins, such as bisphenol-type epoxy resins, novolac-type epoxy resins, biphenyl-type epoxy resins, and naphthalene-type epoxy resins; and aliphatic-based epoxy resins, such as dicyclopentadiene-type epoxy resins.

Examples of urethane resins include urethane resins obtained by reacting at least one diisocyanate compound selected from aliphatic diisocyanate compounds, alicyclic diisocyanate compounds, and aromatic diisocyanate compounds, with at least one polyol compound selected from polyether polyols, polyester polyols, and polycarbonate polyols; urethane resins whose molecular weight is increased by reacting an acrylic resin, a polyester resin, or an epoxy resin mentioned above with a dipolyisocyanate compound; and the like.

The base paint may be an aqueous paint or a solvent-based paint. However, in terms of reducing the VOC of the paint, the base paint is preferably an aqueous paint. When the base paint is an aqueous paint, the base resin can be made soluble in water or dispersed in water by using a resin containing a hydrophilic group, such as a carboxyl group, a hydroxyl group, a methylol group, an amino group, a sulfonic acid group, or a polyoxyethylene group, most typically a carboxyl group, in an amount sufficient for making the resin soluble in water or dispersed in water, and neutralizing the hydrophilic group to form an alkali salt. The amount of the hydrophilic group (e.g., a carboxyl group) used in this case is not particularly limited, and can be suitably selected depending on the degree of water solubilization or water dispersion. However, the amount of the hydrophilic group is generally such that the acid value is about 10 mg KOH/g or more, and preferably 30 to 200 mg KOH/g. Examples of the alkaline substance used in neutralization include sodium hydroxide, amine compounds, and the like.

Moreover, dispersion of the above resin in water can be performed by emulsion polymerization of the monomer components in the presence of a surfactant and a water-soluble resin.

Furthermore, the water dispersion can also be performed by, for example, dispersing the above resin in water in the presence of an emulsifier. In the water dispersion, the base resin may not contain the above hydrophilic group at all, or may contain the above hydrophilic group in an amount that is less than that of the water-soluble resin.

The curing agent is used to crosslink and cure the base resin by heating. Examples include amino resins, polyisocyanate compounds (including unblocked polyisocyanate compounds and blocked polyisocyanate compounds), epoxy-containing compounds, carboxy-containing compounds, carbodiimide group-containing compounds, hydrazide group-containing compounds, semicarbazide group-containing compounds, and the like. Preferable among these are amino resins reactive with a hydroxyl group, polyisocyanate compounds, and carbodiimide group-containing compounds reactive with a carboxyl group. These curing agents can be used singly, or in a combination of two or more.

Specifically, amino resins obtained by condensation or co-condensation of formaldehyde with melamine, benzoguanamine, urea, or the like, or further etherification with a lower monohydric alcohol, are suitably used. Further, a polyisocyanate compound can also be suitably used.

The ratio of each component in the base paint may be freely selected as required. However, in terms of water resistance, finish, and the like, it is generally preferable that the ratio of the base resin is 50 to 90 mass %, and particularly 60 to 85 mass %, based on the total mass of both components; and that the ratio of the curing agent is 10 to 50 mass %, and particularly 15 to 40 mass %, based on the total mass of both components.

An organic solvent can also be used for the base paint, if necessary. Specifically, organic solvents generally used for paints can be used. Examples of organic solvents include hydrocarbons, such as toluene, xylene, hexane, and heptane; esters, such as ethyl acetate, butyl acetate, ethylene glycol monomethyl ether acetate, diethylene glycol monoethyl ether acetate, and diethylene glycol monobutyl acetate; ethers, such as ethylene glycol monomethyl ether, ethylene glycol diethyl ether, diethylene glycol monomethyl ether, and diethylene glycol dibutyl ether; alcohols, such as butanol, propanol, octanol, cyclohexanol, and diethylene glycol; ketones, such as methyl ethyl ketone, methyl isobutyl ketone, cyclohexanone, and isophorone; and other organic solvents. These can be used singly, or in a combination of two or more.

In addition to the above components, the base paint may suitably contain a color pigment, an extender pigment, an ultraviolet absorber, an antifoaming agent, a rheology control agent, a rust inhibitor, a surface adjusting agent, and the like, if necessary.

The base paint is preferably a transparent paint or a colored paint.

When the base paint is a transparent paint, a color pigment is not contained, and an extender pigment can be contained, if necessary. Examples of extender pigments include barium sulfate, barium carbonate, calcium carbonate, aluminum silicate, silica, magnesium carbonate, talc, alumina white, and the like.

When the above extender pigment is mixed, the amount thereof is preferably within the range of 0.1 to 30 parts by mass, and more preferably 0.1 to 20 parts by mass, based on 100 parts by mass of the resin solids content in the paint.

When the base paint is a colored paint, a color pigment is contained. The base paint can contain a titanium oxide pigment and carbon black, in terms of control of light transmittance, and can further contain conventionally known color pigments other than a titanium oxide pigment and carbon black, if necessary. The color pigment is not particularly limited. Specific examples include composite metal oxide pigments, such as iron oxide pigments and titan yellow, azo pigments, quinacridone pigments, diketopyrrolopyrrole pigments, perylene pigments, perinone pigments, benzimidazolone pigments, isoindoline pigments, isoindolinone pigments, metal chelate azo pigments, phthalocyanine pigments, indanthrone pigments, dioxane pigments, threne pigments, indigo pigments, effect pigments, and the like. Any of these pigments can be used singly or in a combination of two or more. Specific examples of effect pigments include those listed as the effect pigments that can be contained in the intermediate paint.

When the above color pigment is mixed, the amount thereof is preferably within the range of 0.1 to 150 parts by mass, and more preferably 0.2 to 100 parts by mass, based on 100 parts by mass of the resin solids content in the paint.

The cured film thickness of the base coating film obtained from the base paint is preferably 3 μm or more, more preferably 3 to 20 μm, and even more preferably 5 to 15 μm, in terms of smoothness, metallic luster, and the like.

Coating of the base paint can be performed by a general method. For example, air spray coating, airless spray coating, rotary atomization coating, and like methods can be used. An electrostatic charge may be applied, if necessary, during coating of the base paint. In particular, rotary atomization electrostatic coating and air spray electrostatic coating are preferable, and rotary atomization electrostatic coating is particularly preferable.

When air spray coating, airless spray coating, or rotary atomization coating is performed, the base paint is preferably adjusted to have a solids content and viscosity suitable for coating by suitably adding water and/or an organic solvent, and optionally additives, such as rheology control agents and antifoaming agents.

The solids content of the base paint is preferably within the range of 10 to 60 mass %, more preferably 15 to 55 mass %, and even more preferably of 20 to 50 mass %. The viscosity of the base paint at 20° C. at 6 rpm measured by a Brookfield-type viscometer is preferably within the range of 200 to 7000 mPa·s, more preferably 300 to 6000 MPa·s, and even more preferably 500 to 5000 mPa·s.

In the method for forming a multilayer coating film according to the present invention, an effect pigment dispersion is applied to the uncured base coating film formed as above, thereby forming an effect pigment-containing coating film. The uncured base coating film is not limited to the coating film immediately after the coating of the base paint, and includes a coating film allowed to stand at room temperature for 15 to 30 minutes after the coating of the base paint, and a coating film heated at 50 to 100° C. for 30 seconds to 10 minutes after the coating of the base paint.

Effect Pigment Dispersion

In the method for forming a multilayer coating film according to the present invention, the effect pigment dispersion is applied to the uncured intermediate coating film or uncured base coating film, thus forming an uncured effect pigment-containing coating film. The effect pigment dispersion contains water, a surface adjusting agent, a flake-effect pigment, and a rheology control agent. The solids content of the effect pigment dispersion is 0.5 to 10 mass %, preferably 0.7 to 9 mass %, and more preferably 1.0 to 8 mass %, in terms of the metallic luster of the coating film to be obtained.

Surface Adjusting Agent

Examples of the surface adjusting agent that can be incorporated into the effect pigment dispersion include one or more surface adjusting agents selected from silicone-based surface adjusting agents, acrylic surface adjusting agents, vinyl-based surface adjusting agents, and fluorine-based surface adjusting agents. These surface adjusting agents can be used singly or in a combination of two or more.

Examples of commercial products of the surface adjusting agent include BYE series (produced by BYK-Chemie), Tego series (produced by Evonik), Glanol series and Polyflow series (produced by Kyoeisha Chemical Co., Ltd.), DISPARLON series (produced by Kusumoto Chemicals, Ltd.), and the like.

The content of the surface adjusting agent in the effect pigment dispersion as a solids content is preferably 0.01 to 4.0 parts by mass, more preferably 0.05 to 3.0 parts by mass, and even more preferably 0.1 to 2.0 parts by mass, based on 100 parts by mass of the effect pigment dispersion, in terms of the excellent metallic luster of the multilayer coating film to be obtained.

Flake-Effect Pigment

Examples of the flake-effect pigment that can be incorporated into the effect pigment dispersion include metal flake pigments, such as vapor deposition metal flake pigments, aluminum flake pigments, and colored aluminum flake pigments; interference pigments; and the like. Of these, vapor deposition metal flake pigments and aluminum flake pigments are preferable, in terms of obtaining a coating film with excellent metallic luster.

The vapor deposition metal flake pigment is obtained by vapor-depositing a metal film on a base material, removing the base material, and then grinding the vapor deposition metal film. Examples of the base material include films and the like.

The material of the above metal is not particularly limited. Examples include aluminum, gold, silver, copper, brass, titanium, chromium, nickel, nickel chromium, stainless steel, and the like. Of these, aluminum or chromium is particularly preferable, in terms of easy availability, ease of handling, and the like. In the present specification, a vapor deposition metal flake pigment obtained by vapor deposition of aluminum refers to a "vapor deposition aluminum flake pigment," and a vapor deposition metal flake pigment obtained by vapor deposition of chromium refers to a "vapor deposition chromium flake pigment."

Examples of commercial products that can be used as the vapor deposition aluminum flake pigment include "METALURE" series (trade name, produced by ECKART), "Hydroshine WS" series (trade name, produced by ECKART), "Decomet" series (trade name, produced by Schlenk), "Metasheen" series (trade name, produced by BASF), and the like.

Examples of commercial products that can be used as the vapor deposition chromium flake pigment include "Metalure Liquid Black" series (trade name, produced by ECKART) and the like.

The average thickness of the vapor deposition metal flake pigment is preferably 0.005 to 1.0 μm, and more preferably 0.01 to 0.1 μm.

The average particle size (D50) of the vapor deposition metal flake pigment is preferably 1 to 50 μm, and more preferably 5 to 20 μm. The above-mentioned average particle size means a major axis.

The surface of the vapor deposition aluminum flake pigment is preferably treated with silica, in terms of storage stability and the excellent metallic luster of the coating film to be obtained.

Aluminum flake pigments are flake pigments containing aluminum as a base material, and can be generally produced by grinding or milling aluminum in a ball mill or an attritor mill in the presence of a grinding liquid medium, using a grinding aid. Usable grinding aids include higher fatty acids, such as oleic acid, stearic acid, isostearic acid, lauric acid, palmitic acid, and myristic acid; as well as aliphatic amine, aliphatic amide, and aliphatic alcohol. As the grinding liquid medium, an aliphatic hydrocarbon, such as mineral spirit, is used. The grinding liquid medium may be replaced by a water-soluble solvent, such as alcohol, depending on chemical treatment after grinding.

Moreover, the aluminum flake pigment is desirably treated to inhibit reaction with water; in particular, the surface of the aluminum flake pigment is preferably treated with silica, in terms of storage stability and the excellent metallic luster of the coating film to be obtained.

The average thickness of the aluminum flake pigment is preferably 0.03 to 2.0 μm, and more preferably 0.05 to 1.0 μm.

The average particle size (D50) of the aluminum flake pigment is preferably about 1 to 50 μm, and more preferably about 5 to 20 μm. This is preferable in terms of the storage stability of the paint, and the excellent metallic luster of the coating film to be obtained. The above-mentioned average particle size means a major axis.

The content of the flake-effect pigment in the effect pigment dispersion as a solids content is preferably 0.2 to 8.0 parts by mass, more preferably 0.3 to 7.0 parts by mass, and even more preferably 0.5 to 6.0 parts by mass, based on 100 parts by mass of the effect pigment dispersion, in terms of the excellent metallic luster of the multilayer coating film to be obtained.

Rheology Control Agent

As the rheology control agent in the effect pigment dispersion, a known rheology control agent can be used. Examples include silica-based fine powder, mineral-based rheology control agents, barium sulfate atomization powder, polyamide-based rheology control agents, organic resin fine particle rheology control agents, diurea-based rheology control agents, urethane association-type rheology control agents, polyacrylic acid-based rheology control agents, which are acrylic swelling-type, cellulose-based rheology control agents, and the like. Of these, particularly in terms of obtaining a coating film with excellent metallic luster, it is preferable to use a mineral-based rheology control agent, a polyacrylic acid-based rheology control agent, or a cellulose-based rheology control agent; and it is particularly preferable to use a cellulose-based rheology control agent. These rheology control agents can be used singly, or in a combination of two or more.

Examples of mineral-based rheology control agents include swelling laminar silicate that has a 2:1 type crystal structure. Specific examples include smectite group clay minerals, such as natural or synthetic montmorillonite, saponite, hectorite, stevensite, beidellite, nontronite, bentonite, and laponite; swelling mica group clay minerals, such as Na-type tetrasilicic fluorine mica, Li-type tetrasilicic fluorine mica, Na salt-type fluorine taeniolite, and Li-type fluorine taeniolite; vermiculite; substitution products or derivatives thereof; and mixtures thereof.

Examples of polyacrylic acid-based rheology control agents include sodium polyacrylate, polyacrylic acid-(meth) acrylic acid ester copolymers, and the like.

Examples of commercial products of the polyacrylic acid-based rheology control agent include "Primal ASE-60," "Primal TT615," and "Primal RM5" (trade names, produced by The Dow Chemical Company); "SN Thickener 613," "SN Thickener 618," "SN Thickener 630," "SN Thickener 634," and "SN Thickener 636" (trade names, produced by San Nopco Limited); and the like. The acid value of the solids content of the polyacrylic acid-based rheology control agent is within the range of 30 to 300 mg KOH/g, and preferably 80 to 280 mg KOH/g.

Examples of cellulose-based rheology control agents include carboxymethylcellulose, methylcellulose, hydroxyethylcellulose, hydroxyethylmethylcellulose, hydroxypropylmethylcellulose, methylcellulose, cellulose nanofibers, and the like. Of these, cellulose nanofibers are particularly preferably used, in terms of obtaining a coating film with excellent metallic luster.

The cellulose nanofibers may also be referred to as cellulose nanofibrils, fibrillated cellulose, or nanocellulose crystals.

The cellulose nanofibers have a number average fiber diameter within the range of preferably 2 to 500 nm, more preferably 2 to 250 nm, and even more preferably 2 to 150 nm, in terms of obtaining a coating film with excellent metallic luster. The cellulose nanofibers also have a number average fiber length within the range of preferably 0.1 to 20 μm, more preferably 0.1 to 15 μm, and even more preferably 0.1 to 10 μm. The aspect ratio determined by dividing a number average fiber length by a number average fiber diameter is within the range of preferably 50 to 10000, more preferably 50 to 5000, and even more preferably 50 to 1000.

The number average fiber diameter and number average fiber length are measured and calculated from, for example, an image obtained by subjecting a sample (cellulose nanofibers diluted with water) to a dispersion treatment, casting the sample on a grid coated with a carbon film that has been subjected to hydrophilic treatment, and observing the sample with a transmission electron microscope (TEM).

The cellulose nanofibers for use may be those obtained by defibrating a cellulose material and stabilizing it in water. The cellulose material as used here refers to cellulose-main materials in various forms. Specific examples include pulp (e.g., grass plant-derived pulp, such as wood pulp, jute, Manila hemp, and kenaf); natural cellulose, such as cellulose produced by microorganisms; regenerated cellulose obtained by dissolving cellulose in a copper ammonia solution, a solvent of a morpholine derivative, or the like, and subjecting the dissolved cellulose to spinning; and fine cellulose obtained by subjecting the cellulose material to mechanical treatment, such as hydrolysis, alkali hydrolysis, enzymatic decomposition, blasting treatment, vibration ball milling, and the like, to depolymerize the cellulose.

The method for defibrating the cellulose material is not particularly limited, as long as the cellulose material remains in a fibrous form. Examples of the method include mechanical defibration treatment using a homogenizer, a grinder, and the like; chemical treatment using an oxidation catalyst and the like; and biological treatment using microorganisms and the like.

For the cellulose nanofibers, anionically modified cellulose nanofibers can be used. Examples of anionically modified cellulose nanofibers include carboxylated cellulose nanofibers, carboxymethylated cellulose nanofibers, and the like. The anionically modified cellulose nanofibers can be obtained, for example, by incorporating functional groups such as carboxyl groups and carboxymethyl groups into a cellulose material by a known method, washing the obtained modified cellulose to prepare a dispersion of the modified cellulose, and defibrating this dispersion. The carboxylated cellulose is also referred to as oxidized cellulose.

The oxidized cellulose is obtained, for example, by oxidizing the cellulose material in water using an oxidizing agent in the presence of a compound selected from the group consisting of N-oxyl compounds, bromide, iodide, and mixtures thereof.

The amount of an N-oxyl compound is not particularly limited, as long as the amount is a catalytic amount that can disintegrate cellulose into nanofibers. The amount of bromide or iodide can be suitably selected within the range in which an oxidation reaction is promoted.

For the oxidizing agent, a known oxidizing agent may be used. Examples include halogen, hypohalous acid, halous acid, perhalogenic acid, salts thereof, halogen oxide, peroxide, and the like. It is preferable to set the conditions so that the amount of carboxyl groups in oxidized cellulose is 0.2 mmol/g or more based on the solids content mass of the oxidized cellulose. The amount of carboxyl groups can be adjusted, for example, by performing the following: adjustment of oxidation reaction time; adjustment of oxidation reaction temperature; adjustment of pH in oxidation reaction; and adjustment of the amount of an N-oxyl compound, bromide, iodide, oxidizing agent, or the like.

The above carboxymethylated cellulose can be obtained, for example, in the following manner. The cellulose material and a solvent are mixed, and mercerization treatment is performed using 0.5 to 20-fold moles of alkali hydroxide metal per glucose residue of the cellulose material as a mercerization agent at a reaction temperature of 0 to 70° C. for a reaction time of about 15 minutes to 8 hours. Thereafter, 0.05 to 10.0-fold moles of a carboxymethylating agent per glucose residue is added thereto, followed by reaction at a reaction temperature of 30 to 90° C. for about 30 minutes to 10 hours.

The degree of substitution of carboxymethyl per glucose unit in the modified cellulose obtained by introducing carboxymethyl groups into the cellulose material is preferably 0.02 to 0.50.

The thus-obtained anion-modified cellulose can be dispersed in an aqueous solvent to form a dispersion, and the dispersion can be further defibrated. Although the defibration method is not particularly limited, when mechanical treatment is performed, the device to be used may be any of the following: a high-speed shearing device, a collider device, a bead mill device, a high-speed rotating device, a colloid mill device, a high-pressure device, a roll mill device, and an ultrasonic device. These devices may be used in a combination of two or more.

Examples of commercial products of cellulose nanofibers include Rheocrysta (registered trademark) produced by DKS Co. Ltd., and the like.

In the method for forming a multilayer coating film according to the present invention, the content of the cellulose-based rheology control agent, when used in the effect pigment dispersion, is preferably 2 to 150 parts by mass, and particularly preferably 3 to 120 parts by mass, based on 100 parts by mass of the flake-effect pigment, in terms of obtaining a coating film with excellent metallic luster.

The content of the rheology control agent in the effect pigment dispersion as a solids content is preferably 0.01 to 3.0 parts by mass, more preferably 0.05 to 2.0 parts by mass, and even more preferably 0.1 to 1.5 parts by mass, based on 100 parts by mass of the effect pigment dispersion, in terms of obtaining a multilayer coating film with excellent metallic luster.

Other Components

The effect pigment dispersion may optionally further include an organic solvent, color pigment, pigment dispersion, antisettling agent, antifoaming agent, ultraviolet absorber, surface adjusting agents other than the surface adjusting agent mentioned above, or various resins.

As the color pigment, any pigments selected from composite metal oxide pigments, such as iron oxide pigments and titan yellow, azo pigments, quinacridone pigments, diketopyrrolopyrrole pigments, perylene pigments, perinone pigments, benzimidazolone pigments, isoindoline pigments, isoindolinone pigments, metal chelate azo pigments, phthalocyanine pigments, indanthrone pigments, dioxane pigments, threne pigments, indigo pigments, carbon black pigments, and the like can be used singly or in a combination of two or more, to enhance the darkness of the multilayer coating film. Considering the darkness of the multilayer coating film obtained by the method of the present invention, the color pigment is preferably selected from non-cloudy chromatic color pigments that develop color in a highly saturated manner, such as perylene pigments, diketopyrrolopyrrole pigments, quinacridone pigments, and phthalocyanine pigments; and used.

The color pigment can be incorporated as a powder into the effect pigment dispersion. Alternatively, the color pigment is mixed and dispersed in the resin composition to form a color pigment dispersion beforehand, and the color pigment dispersion is mixed together with other components to prepare an effect pigment dispersion. In the preparation of the color pigment dispersion, conventional paint additives, such as antifoaming agents, dispersants, and surface adjusting agents, can be used.

When the effect pigment dispersion comprises a color pigment, the content of the color pigment is preferably 10 to 500 parts by mass, more preferably 15 to 400 parts by mass, and even more preferably 20 to 200 parts by mass, based on 100 parts by mass of the flake-effect pigment from the viewpoint of enhancing the lightness and chroma in the highlight of the multilayer coating film.

In particular, when the effect pigment dispersion contains a vapor deposition metal flake pigment or an aluminum flake pigment as a flake-effect pigment, it is preferable that the effect pigment dispersion contains a phosphate group-containing resin, in terms of the metallic luster and water resistance of the coating film to be obtained.

The phosphate group-containing resin can be produced by, for example, copolymerizing a phosphate group-containing polymerizable unsaturated monomer and other polymerizable unsaturated monomers by a known method, such as a solution-polymerization method. Examples of the phosphate group-containing polymerizable unsaturated monomer include acid phosphooxy ethyl(meth)acrylate, acid phosphooxy propyl(meth)acrylate, a reaction product of glycidyl (meth)acrylate and alkyl phosphoric acid, and the like. These can be used singly or in a combination of two or more.

In the phosphate group-containing resin, when the above phosphate group-containing polymerizable unsaturated monomer and another polymerizable unsaturated monomer are copolymerized, the ratio of each monomer used is such that the mass ratio of the former monomer to the latter monomer is preferably about 1/99 to 40/60, more preferably about 5/95 to 35/65, and even more preferably about 10/90 to 30/70.

The effect pigment dispersion may contain a base resin and/or a dispersion resin, in terms of the anti-water adhesion of the coating film and storage stability to be obtained. However, the effects of the present invention can be exhibited even if these resins are not substantially contained.

Examples of the base resin include acrylic resins, polyester resins, alkyd resins, urethane resins, and the like.

As the dispersion resin, existing dispersion resins, such as acrylic resins, epoxy resins, polycarboxylic acid resins, and polyester resins, can be used.

In terms of the anti-water adhesion property of the coating film to be obtained, the effect pigment dispersion may comprise a crosslinkable component. In particular, when a paint that forms a coating film laminated on the effect pigment-containing coating film is a one-component clear paint and does not contain the crosslinkable component, the effect pigment dispersion preferably contains the crosslinkable component.

In the present specification, the crosslinkable component is selected from melamine, a melamine derivative, (meth) acrylamide, a copolymer of N-methylol group- or N-alkoxymethyl group-containing (meth)acrylamide, and a blocked or unblocked polyisocyanate compound.

Examples of melamine derivatives include partially etherified or fully etherified melamine resins produced by etherifying a part or all of methylol groups in methylolated melamine with a $C_{1-8}$ monohydric alcohol, such as methyl alcohol, ethyl alcohol, n-propyl alcohol, i-propyl alcohol, n-butyl alcohol, i-butyl alcohol, 2-ethylbutanol, or 2-ethylhexanol.

Examples of commercially available melamine derivatives include Cymel 202, Cymel 232, Cymel 235, Cymel 238, Cymel 254, Cymel 266, Cymel 267, Cymel 272, Cymel 285, Cymel 301, Cymel 303, Cymel 325, Cymel 327, Cymel 350, Cymel 370, Cymel 701, Cymel 703, and Cymel 1141 (all produced by Nihon Cytec Industries Inc.); U-Van 20SE60, U-Van 122, and U-Van 28-60 (all produced by Mitsui Chemicals, Inc.); Super Beckamine J-820-60, Super Beckamine L-127-60, and Super Beckamine G-821-60 (all produced by DIC); and the like. The above melamine and melamine derivatives can be used singly or in a combination of two or more.

Examples of the N-methylol group- or N-alkoxymethyl group-containing (meth)acrylamide include (meth)acrylamides, such as N-methylolacrylamide, N-methoxymethylacrylamide, N-methoxybutylacrylamide, and N-butoxymethyl(meth)acrylamide. The above (meth)acrylamide derivatives can be used singly or in a combination of two or more.

The unblocked polyisocyanate compound is a compound having at least two isocyanate groups per molecule. Examples include aliphatic polyisocyanates, alicyclic polyisocyanates, aliphatic-aromatic polyisocyanates, aromatic polyisocyanates, derivatives of these polyisocyanates, and the like.

Examples of aliphatic polyisocyanates include aliphatic diisocyanates, such as trimethylene diisocyanate, tetramethylene diisocyanate, hexamethylene diisocyanate, pentamethylene diisocyanate, 1,2-propylene diisocyanate, 1,2-butylene diisocyanate, 2,3-butylene diisocyanate, 1,3-butylene diisocyanate, 2,4,4- or 2,2,4-trimethylhexamethylene diisocyanate, dimer acid diisocyanate, and methyl 2,6-diisocyanatohexanoate (common name: lysine diisocyanate); aliphatic triisocyanates, such as 2-isocyanatoethyl diisocyanatohexanoate, 1,6-diisocyanate-3-isocyanatomethylhexane, 1,4,8-triisocyanatooctane, 1,6,11-triisocyanatoundecane, 1,8-diisocyanato-4-isocyanatomethyloctane, 1,3,6-triisocyanatohexane, and 2,5,7-trimethyl-1,8-diisocyanato-5-isocyanatomethyloctane; and the like.

Examples of alicyclic polyisocyanates include alicyclic diisocyanates, such as 1,3-cyclopentene diisocyanate, 1,4-cyclohexane diisocyanate, 1,3-cyclohexane diisocyanate, 3-isocyanatomethyl-3,5,5-trimethylcyclohexyl isocyanate (common name: isophorone diisocyanate), 4-methyl-1,3-cyclohexylene diisocyanate (common name: hydrogenated TDI), 2-methyl-1,3-cyclohexylene diisocyanate, 1,3- or 1,4-bis(isocyanatomethyl)cyclohexane (common name: hydrogenated xylylene diisocyanate) or mixtures thereof, and methylenebis(4,1-cyclohexanediyl)diisocyanate (common name: hydrogenated MDI), and norbornane diisocyanate; alicyclic triisocyanates, such as 1,3,5-triisocyanatocyclohexane, 1,3,5-trimethylisocyanatocyclohexane, 2-(3-isocyanatopropyl)-2,5-di(isocyanatomethyl)-bicyclo(2.2.1)heptane, 2-(3-isocyanatopropyl)-2,6-di(isocyanatomethyl)-bicyclo(2.2.1)heptane, 3-(3-isocyanatopropyl)-2,5-di(isocyanatomethyl)-bicyclo(2.2.1)heptane, 5-(2-isocyanatoethyl)-2-isocyanatomethyl-3-(3-isocyanatopropyl)-bicyclo(2.2.1)heptane, 6-(2-isocyanatoethyl)-2-isocyanatomethyl-3-(3-isocyanatopropyl-bicyclo(2.2.1)heptane, 5-(2-isocyanatoethyl)-2-isocyanatomethyl-2-(3-isocyanatopropyl)-bicyclo(2.2.1)heptane, and 6-(2-isocyanatoethyl)-2-isocyanatomethyl-2-(3-isocyanatopropyl)-bicyclo(2.2.1)heptane; and the like.

Examples of aromatic-aliphatic polyisocyanates include aromatic-aliphatic diisocyanates, such as methylenebis(4,1-phenylene)diisocyanate (common name: MDI), 1,3- or 1,4-xylylene diisocyanate or mixtures thereof, ω,ω'-diisocyanato-1,4-diethylbenzene, and 1,3- or 1,4-bis(1-isocyanato-1-methylethyl)benzene (common name: tetramethylxylylene diisocyanate) or mixtures thereof; aromatic-aliphatic triisocyanates, such as 1,3,5-triisocyanatomethylbenzene; and the like.

Examples of aromatic polyisocyanates include aromatic diisocyanates, such as m-phenylene diisocyanate, p-phenylene diisocyanate, 4,4'-diphenyl diisocyanate, 1,5-naphthalene diisocyanate, 2,4-tolylene diisocyanate (common name: 2,4-TDI), or 2,6-tolylene diisocyanate (common name: 2,6-TDI) or mixtures thereof, 4,4'-toluidine diisocyanate, and 4,4'-diphenylether diisocyanate; aromatic triisocyanates, such as triphenylmethane-4,4',4"-triisocyanate, 1,3,5-triisocyanatobenzene, and 2,4,6-triisocyanatotoluene; aromatic tetraisocyanates, such as 4,4'-diphenylmethane-2,2',5,5'-tetraisocyanate; and the like.

Examples of polyisocyanate derivatives include dimers, trimers, biurets, allophanates, urethodiones, urethoimines, isocyanurates, oxadiazinetriones, polymethylene polyphenyl polyisocyanates (crude MDI, polymeric MDI), crude TDI, and the like, of the above-mentioned polyisocyanates. These polyisocyanate derivatives may be used singly or in a combination of two or more. The above polyisocyanates and derivatives thereof may be used singly or in a combination of two or more.

Among the aliphatic diisocyanates, hexamethylene diisocyanate-based compounds are preferably used, and among the alicyclic diisocyanates, 4,4'-methylenebis(cyclohexyl isocyanate) is preferably used. Of these, derivatives of hexamethylene diisocyanate are particularly the most preferable, in terms of adhesion, compatibility, and the like.

As the polyisocyanate compound, it is also possible to use a prepolymer formed by reacting the polyisocyanate or a derivative thereof with a compound having active hydrogen, such as hydroxy or amino, and reactive to the polyisocyanate under conditions such that the isocyanate groups are present in excess. Examples of the compound reactive to the polyisocyanate include polyhydric alcohols, low-molecular-weight polyester resins, amine, water, and the like. The above polyisocyanate compounds can be used singly or in a combination of two or more.

The blocked polyisocyanate compound is a blocked polyisocyanate compound in which some or all of the isocyanate groups of the above polyisocyanate or a derivative thereof are blocked with a blocking agent.

Examples of the blocking agent include the following: phenol-based blocking agents, such as phenol, cresol, xylenol, nitrophenol, ethylphenol, hydroxydiphenyl, butylphenol, isopropylphenol, nonylphenol, octylphenol, and methyl hydroxybenzoate; lactam-based blocking agents, such as ε-caprolactam, δ-valerolactam, γ-butyrolactam, and β-propiolactam; aliphatic alcohol-based blocking agents, such as methanol, ethanol, propyl alcohol, butyl alcohol, amyl alcohol, and lauryl alcohol; ether-based blocking agents, such as ethylene glycol monomethyl ether, ethylene glycol monoethyl ether, ethylene glycol monobutyl ether, diethylene glycol monomethyl ether, diethylene glycol monoethyl ether, propylene glycol monomethyl ether, and methoxymethanol; alcohol-based blocking agents, such as benzyl alcohol, glycolic acid, methyl glycolate, ethyl glycolate, butyl glycolate, lactic acid, methyl lactate, ethyl lactate, butyl lactate, methylol urea, methylol melamine, diacetone alcohol, 2-hydroxyethyl acrylate, and 2-hydroxyethyl methacrylate; oxime-based blocking agents, such as formamide oxime, acetamide oxime, acetoxime, methyl ethyl ketoxime, diacetyl monoxime, benzophenone oxime, and cyclohexane oxime; active methylene-based blocking agents, such as dimethyl malonate, diethyl malonate, ethyl acetoacetate, methyl acetoacetate, and acetylacetone; mercaptan-based blocking agents, such as butyl mercaptan, t-butyl mercaptan, hexyl mercaptan, t-dodecyl mercaptan, 2-mercaptobenzothiazole, thiophenol, methylthiophenol, and ethylthiophenol; acid amide-based blocking agents, such as acetanilide, acetanisidide, acetotoluide, acrylamide, methacrylamide, acetic acid amide, stearic acid amide, and benzamide; imide-based blocking agents, such as succinimide, phthalimide, and maleimide; amine-based blocking agents, such as diphenylamine, phenylnaphthylamine, xylidine, N-phenylxylidine, carbazole, aniline, naphthylamine, butylamine, dibutylamine, and butylphenylamine; imidazole-based blocking agents, such as imidazole and 2-ethylimidazole; urea-based blocking agents, such as urea, thiourea, ethyleneurea, ethylenethiourea, and diphenylurea; carbamate-based blocking agents, such as phenyl N-phenylcarbamate; imine-based blocking agents, such as ethyleneimine and propyleneimine; sulfite-based blocking agents, such as sodium bisulfite and potassium bisulfite; and azole-based compounds. Examples of azole-based compounds include pyrazole or pyrazole derivatives, such as pyrazole, 3,5-dimethylpyrazole, 3-methylpyrazole, 4-benzyl-3,5-dimethylpyrazole, 4-nitro-3,5-dimethylpyrazole, 4-bromo-3,5-dimethylpyrazole, and 3-methyl-5-phenylpyrazole; imidazole or imidazole derivatives, such as imidazole, benzimidazole, 2-methylimidazole, 2-ethylimidazole, and 2-phenylimidazole; and imidazoline derivatives, such as 2-methylimidazoline and 2-phenylimidazoline.

When blocking is performed (a blocking agent is reacted), it can be performed by adding a solvent, if necessary. As the solvent used in the blocking reaction, a solvent that is not reactive with an isocyanate group is preferably used. Examples include ketones, such as acetone and methyl ethyl ketone; esters, such as ethyl acetate; N-methyl-2-pyrrolidone (NMP); and like solvents. The above blocked polyisocyanate compounds can be used singly or in a combination of two or more.

When the effect pigment dispersion contains a crosslinkable component, the content thereof as a solids content is preferably within the range of 1 to 100 parts by mass, more preferably 5 to 95 parts by mass, and even more preferably 10 to 90 parts by mass, based on 100 parts by mass of the solids content of the flake-effect pigment in the effect pigment dispersion, in terms of the anti-water adhesion of the coating film.

When the effect pigment dispersion contains a base resin and a dispersion resin described above, and further contains a crosslinkable component, the total amount as a solids content of the base resin, the dispersion resin, and the crosslinkable component is, in terms of forming a coating film with metallic luster, preferably within the range of 1 to 500 parts by mass, more preferably 5 to 300 parts by mass, and even more preferably 10 to 100 parts by mass, based on 100 parts by mass of the solids content of the flake-effect pigment in the effect pigment dispersion, in terms of the anti-water adhesion of the coating film.

Solids Content

It is preferable that the amount of each component is determined so that the effect pigment dispersion in the method for forming a multilayer coating film according to the present invention has a solids content of 0.5 to 10 mass % from the viewpoint of forming a coating film with excellent metallic luster. The solids content is specifically defined as a numerical value obtained as follows. Specifically, about 1 g of the sample was weighed on an aluminum dish, and dried immediately in a hot-air drying oven in an atmosphere of 110° C. for 1 hour. The mass of the sample after drying was measured, and the mass of the sample obtained after drying was divided by the mass of the sample weighed beforehand.

Coating of Effect Pigment Dispersion

In the coating of the effect pigment dispersion, the viscosity of the effect pigment dispersion at a temperature of 20° C. measured by a Brookfield-type viscometer at 60 rpm after 1 minute (also referred to as "the B60 value" in the present specification) is preferably adjusted to 60 to 2000 mPa·s, more preferably 60 to 1500 mPa·s, and even more preferably 60 to 1000 mPa·s, in terms of obtaining a coating film with excellent metallic luster. The viscometer used in this case is a Brookfield-type viscometer (trade name: LVDV-I, produced by Brookfield).

The effect pigment dispersion can be applied by a method such as electrostatic coating, air spray coating, or airless spray coating. In the method for forming a multilayer coating film of the present invention, rotary atomization electrostatic coating is particularly preferable.

In the method for forming a multilayer coating film according to the present invention, the clear paint or colored transparent paint can be applied to the uncured effect pigment-containing coating film obtained by applying the effect pigment dispersion. The uncured effect pigment-containing coating film is preferably dried. The method of drying the effect pigment-containing coating film is not particularly limited. For example, a method that allows the coating film to stand at ordinary temperature for 15 to 30 minutes, a method that performs preheating at a temperature of 50 to 100° C. for 30 seconds to 10 minutes, or the like, can be used.

The film thickness 30 seconds after the effect pigment dispersion is attached to the substrate is preferably 3 to 50 μm, more preferably 4 to 40 μm, and even more preferably 5 to 30 μm, in terms of obtaining a coating film with excellent metallic luster.

The thickness of the effect pigment-containing coating film, as dry film thickness, is preferably 0.02 to 5.0 μm, more preferably 0.02 to 4.0 μm, and even more preferably 0.02 to 3.5 μm, in terms of obtaining a coating film with excellent metallic luster.

In particular, when the flake-effect pigment in the effect pigment dispersion is a vapor deposition metal flake pigment, the thickness of the effect pigment-containing coating film, as dry film thickness, is preferably 0.02 to 2.0 μm, and more preferably 0.05 to 1.5 μm, in terms of obtaining a coating film with excellent metallic luster.

In particular, when the flake-effect pigment in the effect pigment dispersion is an aluminum flake pigment, the thickness of the effect pigment-containing coating film, as dry film thickness, is preferably 0.05 to 5.0 μm, more preferably 0.1 to 4.0 μm, and even more preferably 0.15 to 3.5 μm, in terms of obtaining a coating film with excellent metallic luster.

In the present specification, the dry film thickness is defined by the numerical value calculated from the following formula (1):

$$x=(sc*10000)/(S*sg) \quad (1)$$

x: film thickness [μm]

sc: coating solids content [g]

S: evaluation area of coating solids content [$cm^2$]

sg: coating film specific gravity [$g/cm^3$]

In the method for forming a multilayer coating film according to the present invention, a clear paint is applied to the uncured effect pigment-containing coating film formed as above to form a clear coating film. The uncured effect pigment-containing coating film is not limited to a coating film obtained immediately after the application of the effect pigment dispersion, but also includes a coating film that is allowed to stand at room temperature for 15 to 30 minutes after the application of the effect pigment dispersion, and a coating film that is heated at 50 to 100° C., for 30 seconds to 10 minutes after the application of the effect pigment dispersion.

Clear Paint

In the method for forming a multilayer coating film of the present invention, a clear paint can be applied to the uncured effect pigment-containing coating film obtained by applying the effect pigment dispersion. The clear paint for use may be any known thermosetting clear-coat paint compositions. Examples of the thermosetting clear-coat paint composition include those containing a base resin having crosslinkable functional groups and a curing agent, such as organic solvent-based thermosetting paint compositions, aqueous thermosetting paint compositions, and powdery thermosetting paint compositions.

Examples of the crosslinkable functional groups contained in the base resin include a carboxyl group, a hydroxyl group, an epoxy group, a silanol group, and the like. Examples of the type of the base resin include acrylic resin, polyester resin, alkyd resin, urethane resin, epoxy resin, fluorine resin, and the like. Examples of the curing agent include polyisocyanate compounds, blocked polyisocyanate compounds, melamine resin, urea resin, carboxy-containing compounds, carboxy-containing resin, epoxy-containing resin, epoxy-containing compounds, and the like.

The combination of the base resin and the curing agent for the clear paint is preferably a carboxy-containing resin and an epoxy-containing resin, a hydroxy-containing resin and a polyisocyanate compound, a hydroxy-containing resin and a blocked polyisocyanate compound, a hydroxy-containing resin and melamine resin, and the like.

Further, the clear paint may be a one-component paint or a multi-component paint, such as a two-component paint.

In particular, the clear paint is preferably a two-component clear paint containing the following hydroxy-containing resin and a polyisocyanate compound, in terms of the adhesion of the obtained coating film.

When a two-component clear paint containing a hydroxy-containing resin and an isocyanate-containing compound is used as the clear paint, a state in which the hydroxy-containing resin and the polyisocyanate compound are separately present is preferable in terms of storage stability. They are mixed and prepared into a two-component composition immediately before use.

When the one-component clear paint is used, the combination of the base resin and the curing agent for the one-component clear paint is a carboxy-containing resin and an epoxy-containing resin, a hydroxy-containing resin and a blocked polyisocyanate compound, a hydroxy-containing resin and melamine resin, and the like.

Hydroxy-Containing Resin

As the hydroxy-containing resin, conventionally known resins can be used without limitation, as long as they are resins containing a hydroxyl group. Examples of the hydroxy-containing resin include hydroxy-containing acrylic resins, hydroxy-containing polyester resins, hydroxy-containing polyether resins, hydroxy-containing polyurethane resins, and the like; preferably hydroxy-containing acrylic resins and hydroxy-containing polyester resins; and particularly preferably hydroxy-containing acrylic resins.

The hydroxy value of the hydroxy-containing acrylic resin is preferably within the range of 80 to 200 mg KOH/q, and more preferably 100 to 180 mg KOH/g in terms of the scratch resistance and water resistance of the coating film.

The weight average molecular weight of the hydroxy-containing acrylic resin is preferably within the range of 2500 to 40000, and more preferably 5000 to 30000, in terms of the acid resistance and smoothness of the coating film.

In the present specification, the weight average molecular weight and the number average molecular weight are defined as numerical values calculated from a chromatogram measured by gel permeation chromatography based on the molecular weight of standard polystyrene. For the gel permeation chromatography, "HLC8120GPC" (produced by Tosoh Corporation) was used. The measurement was conducted using the four columns "TSKgel G-4000HXL," "TSKgel G-3000HXL," "TSKgel G-2500HXL," and "TSKgel G-2000HXL" (trade names, all produced by Tosoh Corporation) under the conditions of mobile phase: tetrahydrofuran, measuring temperature: 40° C., flow rate: 1 cc/min, and detector: RI.

The glass transition temperature of the hydroxy containing acrylic resin is preferably −40° C. to 20° C., and particularly preferably −30° C. to 10° C. When the glass transition temperature is less than −40° C., the curability of the coating film may be insufficient, and when the glass transition temperature exceeds 20° C., the coating surface smoothness of the coating film may be reduced.

Polyisocyanate Compound

A polyisocyanate compound is a compound having at least two isocyanate groups per molecule. Examples include aliphatic polyisocyanates, alicyclic polyisocyanates, aliphatic-aromatic polyisocyanates, aromatic polyisocyanates, derivatives of these polyisocyanates, and the like.

Examples of aliphatic polyisocyanates include aliphatic diisocyanates, such as trimethylene diisocyanate, tetramethylone diisocyanate, hexamethylene diisocyanate, pentamethylene diisocyanate, 1,2-propylene diisocyanate, 1,2-butylene diisocyanate, 2,3-butylene diisocyanate, 1,3-butylene diisocyanate, 2,4,4- or 2,2,4-trimethylhexamethylene diisocyanate, dimer acid diisocyanate, and methyl 2,6-diisocyanatohexanoate (common name: lysine diisocyanate); aliphatic triisocyanates, such as 2-isocyanatoethyl 2,6-diisocyanatohexanoate, 1,6-diisocyanato-3-isocyanatomethylhexane, 1,4,8-triisocyanatooctane, 1,6,11-triisocyanatoundecane, 1,8-diisocyanato-4-isocyanatomethyloctane, 1,3,6-triisocyanatohexane, and 2,5,7-trimethyl-1,8-diisocyanato-5-isocyanatomethyloctane; and the like.

Examples of alicyclic polyisocyanates include alicyclic diisocyanates, such as 1,3-cyclopentene diisocyanate, 1,4-cyclohexane diisocyanate, 1,3-cyclohexane diisocyanate, 3-isocyanatomethyl-3,5,5-trimethylcyclohexyl isocyanate (common name: isophorone diisocyanate), 4-methyl-1,3-cyclohexylene diisocyanate (common name: hydrogenated TDI), 2-methyl-1,3-cyclohexylene diisocyanate, 1,3- or 1,4-bis(isocyanatomethyl)cyclohexane (common name: hydrogenated xylylene diisocyanate) or mixtures thereof, and methylenebis(4,1-cyclohexanediyl)diisocyanate (common name: hydrogenated MDI), and norbornane diisocyanate; alicyclic triisocyanates, such as 1,3,5-triisocyanatocyclohexane, 1,3,5-trimethylisocyanatocyclohexane, 2-(3-isocyanatopropyl)-2,5-di(isocyanatomethyl)-bicyclo(2.21)heptane, 2-(3-isocyanatopropyl)-2,6-di(isocyanatomethyl)-bicyclo(2.2.1)heptane, 3-(3-isocyanatopropyl)-2,5-di(isocyanatomethyl)-bicyclo(2.2.1)heptane, 5-(2-isocyanatoethyl)-2-isocyanatomethy-3-(3-isocyanatopropyl)-bicyclo(2.2.1)heptane, 6-(2-isocyanatoethyl)-2-isocyanatomethyl-3-(3-isocyanatopropyl)-bicyclo(2.2.1)heptane, 5-(2-isocyanatoethyl)-2-isocyanatomethyl-2-(3-isocyanatopropyl)-bicyclo(2.2.1)heptane, and 6-(2-isocyanatoethyl)-2-isocyanatomethyl-2-(3-isocyanatopropyl)-bicyclo(2.2.1)heptane; and the like.

Examples of aliphatic-aromatic polyisocyanates include aliphatic-aromatic diisocyanates, such as methylenebis(4,1-phenylene)diisocyanate (common name: MDI), 1,3- or 1,4-xylylene diisocyanate or mixtures thereof, ω,ω'-diisocyanato-1,4-diethylbenzene, and 1,3- or 1,4-bis(1-isocyanato-1-(common name: tetramethylxylylene diisocyanate) or mixtures thereof; aliphatic-aromatic triisocyanates, such as 1,3,5-triisocyanatomethylbenzene; and the like.

Examples of aromatic polyisocyanates include aromatic diisocyanates, such as m-phenylene diisocyanate, p-phenylene diisocyanate, 4,4'-diphenyl diisocyanate, 1,5-naphthalene diisocyanate, 2,4-tolylene diisocyanate (common name: 2,4-TDI), or 2,6-tolylene diisocyanate (common name: 2,6-TDI) or mixtures thereof, 4,4'-toluidine diisocyanate, and 4,4'-diphenylether diisocyanate; aromatic triisocyanates, such as triphenylmethane-4,4',4"-triisocyanate, 1,3,5-triisocyanatobenzene, and 2,4,6-triisocyanatotoluene; aromatic tetraisocyanates, such as 4,4'-diphenylmethane-2,2',5,5'-tetraisocyanate; and the like.

Examples of polyisocyanate derivatives include dimers, trimers, biurets, allophanates, urethodiones, urethoimines, isocyanurates, oxadiazinetriones, polymethylene polyphenyl polyisocyanates (crude MDI, polymeric MDI), crude TDI, and the like, of the above-mentioned polyisocyanates.

The above polyisocyanates and derivatives thereof may be used singly or in a combination of two or more.

Among the aliphatic diisocyanates, hexamethylene diisocyanate-based compounds are preferably used, and among the alicyclic diisocyanates, 4,4'-methylenebis(cyclohexyl isocyanate) is preferably used. Of these, derivatives of hexamethylene diisocyanate are particularly the most preferable, in terms of adhesion, compatibility, and the like.

As the polyisocyanate compound, a prepolymer is also usable that is formed by reacting the polyisocyanate or a derivative thereof with a compound having active hydrogen, such as hydroxy or amino, and reactive to the polyisocyanate under conditions such that the isocyanate groups are present in excess. Examples of the compound reactive to the polyisocyanate include polyhydric alcohols, low-molecular-weight polyester resins, amine, water, and the like.

The polyisocyanate compound for use may be a blocked polyisocyanate compound in which some or all of the isocyanate groups of the above polyisocyanate or a derivative thereof are blocked with a blocking agent.

Examples of the blocking agent include the following: phenol-based blocking agents, such as phenol, cresol, xylenol, nitrophenol, ethylphenol, hydroxydiphenyl, butylphenol, isopropylphenol, nonylphenol, octylphenol, and methyl hydroxybenzoate; lactam-based blocking agents, such as ε-caprolactam, δ-valerolactam, γ-butyrolactam, and β-propiolactam; aliphatic alcohol-based blocking agents, such as methanol, ethanol, propyl alcohol, butyl alcohol, amyl alcohol, and lauryl alcohol; ether-based blocking agents, such as ethylene glycol monomethyl ether, ethylene glycol monoethyl ether, ethylene glycol monobutyl ether, diethylene glycol monomethyl ether, diethylene glycol monoethyl ether, propylene glycol monomethyl ether, and methoxymethanol; alcohol-based blocking agents, such as benzyl alcohol, glycolic acid, methyl glycolate, ethyl glycolate, butyl glycolate, lactic acid, methyl lactate, ethyl lactate, butyl lactate, methylol urea, methylol melamine, diacetone alcohol, 2-hydroxyethyl acrylate, and 2-hydroxyethyl methacrylate; oxime-based blocking agents, such as formamide oxime, acetamide oxime, acetoxime, methyl ethyl ketoxime, diacetyl monoxime, benzophenone oxime, and cyclohexane oxime; active methylene-based blocking agents, such as dimethyl malonate, diethyl malonate, ethyl acetoacetate, methyl acetoacetate, and acetylacetone; mercaptan-based blocking agents, such as butyl mercaptan, t-butyl mercaptan, hexyl mercaptan, t-dodecyl mercaptan, 2-mercaptobenzothiazole, thiophenol, methylthiophenol, and ethylthiophenol; acid amide-based blocking agents, such as acetanilide, acetanisidide, acetotoluide, acrylamide, methacrylamide, acetic acid amide, stearic acid amide, and benzamide; imide-based blocking agents, such as succinimide, phthalimide, and maleimide; amine-based blocking agents, such as diphenylamine, phenylnaphthylamine, xylidine, N-phenylxylidine, carbazole, aniline, naphthylamine, butylamine, dibutylamine, and butylphenylamine; imidazole-based blocking agents, such as imidazole and 2-ethylimidazole; urea-based blocking agents, such as urea, thiourea, ethyleneurea, ethylenethiourea, and diphenylurea; carbamate-based blocking agents, such as phenyl N-phenylcarbamate; imine-based blocking agents, such as ethyleneimine and propyleneimine; sulfite-based blocking agents, such as sodium bisulfite and potassium bisulfite; and azole-based compounds. Examples of azole-based compounds include pyrazole or pyrazole derivatives, such as pyrazole, 3,5-dimethylpyrazole, 3-methylpyrazole, 4-benzyl-3,5-dimethylpyrazole, 4-nitro-3,5-dimethylpyrazole, 4-bromo-3,5-dimethylpyrazole, and 3-methyl-5-phenylpyrazole; imidazole or imidazole derivatives, such as imidazole, benzimidazole, 2-methylimidazole, 2-ethylimidazole, and 2-phenylimidazole; and imidazoline derivatives, such as 2-methylimidazoline and 2-phenylimidazoline.

When blocking is performed (a blocking agent is reacted), it can be performed by adding a solvent, if necessary. As the solvent used in the blocking reaction, a solvent that is not reactive with an isocyanate group is preferably used. Examples include ketones, such as acetone and methyl ethyl ketone; esters, such as ethyl acetate; N-methyl-2-pyrrolidone (NMP); and like solvents.

The polyisocyanate compounds and derivatives thereof can be used singly or in a combination of two or more. In the present invention, the equivalent ratio of the hydroxyl groups in the hydroxy-containing resin to the isocyanate groups in the polyisocyanate compound (OH/NCO) is preferably within the range of 0.5 to 2.0, and more preferably 0.8 to 1.5, in terms of the curability, scratch resistance, and the like of the coating film.

The clear paint may suitably contain additives, such as solvents (e.g., water and organic solvents), curing catalysts, antifoaming agents, and ultraviolet absorbers, if necessary.

The clear paint may suitably contain a color pigment within a range that does not impair transparency. As the color pigment, conventionally known pigments for ink or paints can be used singly or in a combination of two or more. The amount thereof to be added may be suitably determined, but is preferably 30 parts by mass or less, and more preferably 0.01 to 10 parts by mass, based on 100 parts by mass of the vehicle-forming resin composition in the clear paint.

The form of the clear paint is not particularly limited. The clear paint is generally used as an organic solvent-based paint composition. Examples of the organic solvent used in this case include various organic solvents for paints, such as aromatic or aliphatic hydrocarbon solvents, ester solvents, ketone solvents, ether solvents, and the like. As the organic solvent used herein, the one used in the preparation of the hydroxy-containing resin may be used as is, or other organic solvents may be further suitably added.

The solids concentration of the clear paint is preferably about 30 to 70 mass %, and more preferably about 40 to 60 mass %.

In the method for forming a multilayer coating film according to the present invention, when the clear paint is applied to the uncured effect pigment-containing coating film to form a clear coating film, the coating of the clear paint is not particularly limited, and the same method as those for the base paint may be used. For example, the clear paint can be applied by a coating method, such as air spray coating, airless spray coating, rotary atomization coating, or curtain coating. In these coating methods, an electrostatic charge may be applied, if necessary. Among these, rotary atomization coating using an electrostatic charge is preferable. The coating amount of the clear paint is preferably an amount in which the cured film thickness is about 10 to 50 μm.

Moreover, when the clear paint is applied, it is preferable to suitably adjust the viscosity of the clear paint within a viscosity range suitable for the coating method. For example, for rotary atomization coating using an electrostatic charge, it is preferable to suitably adjust the viscosity of the clear paint within a range of about 15 to 60 seconds measured by a Ford cup No. 4 viscometer at 20° C. using a solvent, such as an organic solvent.

In the method for forming a multilayer coating film according to the present invention, in the case when the uncured base coating film, uncured effect pigment-containing coating film, and uncured clear coating film are laminated, these three coating films can be simultaneously cured by heating. Heating can be performed by known means. For example, drying furnaces such as hot-air furnaces, electric furnaces, and infrared induction heating furnaces can be used. The heating temperature is preferably within the range of 70 to 150° C., and more preferably within the range of 80 to 140° C. The heating time is not particularly limited, and it is preferably within the range of 10 to 40 minutes, and more preferably 20 to 30 minutes.

Colored Transparent Paint

In the method for forming a multilayer coating film of the present invention, a colored transparent paint can be applied to the uncured effect pigment-containing coating film or the heat-cured clear coating film, to form a colored transparent coating film having a total light transmittance at a wavelength of 400 nm to 700 nm of 20 to 70%.

The colored transparent paint is used for enhancing the chroma of the multilayer coating film in highlight. The colored transparent paint is preferably a thermosetting paint commonly used in this field, and contains a color pigment, a base resin, and a curing agent, as well as a medium comprising water and/or an organic solvent.

Color Pigment

Specific examples of the color pigment include organic pigments, such as azo pigments, quinacridone pigments, diketopyrrolopyrrole pigments, perylene pigments, perinone pigments, benzimidazolone pigments, isoindoline pigments, isoindolinone pigments, metal chelate azo pigments, phthalocyanine pigments, indanthrone pigments, dioxazine pigments, threne pigments, and indigo pigments; carbon black pigments; and the like. These pigments can be used singly or in a combination of two or more.

As the color pigment in the colored transparent paint, it is preferable to use a transparent pigment having high transparency and a small primary particle size to enhance the chroma of the multilayer coating film. From the viewpoint of transparency and tinting power, the primary particle size of the color pigment is preferably 10 to 250 nm, and more preferably 20 to 200 nm.

The transparent pigment in the present invention is a pigment satisfying the following feature. When a paint containing a coloring material and a resin as a vehicle formation component is prepared, and when the transparent pigment is contained in this paint as the sole coloring material in an amount of 1 part by mass, per 100 parts by mass of the resin solids content, a coating film that is formed of this paint to have a film thickness of 100 μm achieves a haze value of 0.1 to 10.0. From the viewpoint of the chrome of the multilayer coating film, the haze value is preferably within the range of 0.1 to 7.5, particularly preferably 0.1 to 5, and further preferably 0.1 to 3.

In the present specification, the haze value is defined as a numerical value calculated according to the following equation (2).

$$\text{Haze value}=100*DF/(DF+PT) \quad (2)$$

In equation (2), DF and PT are respectively a diffuse light transmittance rate and a parallel light transmittance rate of a coating film obtained by applying the above paint to a smooth PTFE plate, followed by curing and peeling. The DF and PT of the coating film are measured using a Turbidimeter COH-300A (trade name, produced by Nippon Denshoku Industries Co., Ltd.).

From the viewpoint of attaining a light transmittance of the colored transparent coating film in the above range, the amount of the color pigment in the colored transparent paint is preferably within the range of 0.01 to 3.0 parts by mass, more preferably 0.1 to 2.0 parts by mass, and even more preferably 0.5 to 1.8 parts by mass, per 100 parts by mass of the total resin solids content in the colored transparent paint.

The colored transparent coating film has a light transmittance at a wavelength of 400 to 700 nm of 20 to 70%, and more preferably 25 to 60%, in its coating film thickness. A person skilled in the art can determine the amount of the color pigment so that the light transmittance at a wavelength of 400 to 700 nm of the colored transparent coating film is within the above range.

In the present specification, the light transmittance at a wavelength of 400 to 700 nm indicates the average of the light transmittance that is measured at each wavelength in the range of 400 to 700 nm with a spectrophotometer "MPS-2450" (trade name, produced by Shimadzu Co., Ltd.).

The colored transparent paint may generally contain a resin component as a vehicle. As a resin component, a thermosetting resin composition is preferably used. Specific examples thereof include thermosetting resin compositions comprising a base resin having crosslinkable functional groups (e.g., hydroxy), such as acrylic resin, polyester resin, alkyd resin, and urethane resin, and a crosslinking agent, such as melamine resin, urea resin, and a polyisocyanate compound (including a blocked polyisocyanate compound). Such thermosetting resin compositions are dissolved or dispersed in a solvent such as an organic solvent and/or water, before use. The proportion of the base resin and the crosslinking agent in the resin composition is not particularly limited. The crosslinking agent is preferably within the range of 10 to 100 mass %, more preferably 20 to 80 mass %, and even more preferably 30 to 60 mass %, based on the total base resin solids content.

The colored transparent paint may suitably contain solvents, such as water or an organic solvent; various additives for paints, such as a rheology control agent, a pigment dispersant, an antisettling agent, a curing catalyst, an antifoaming agent, an antioxidizing agent, and an ultraviolet absorber; an extender pigment; and the like; if necessary.

In the method for forming a multilayer coating film according to the present invention, when the colored transparent paint is applied to the multilayer coating film that includes the formed clear coating film, to form a colored transparent coating film, the coating of the colored transparent paint is not particularly limited, and the same method as those for the base paint may be used. For example, the colored transparent paint can be applied by a coating method, such as air spray coating, airless spray coating, rotary atomization coating, or curtain coating. In these coating methods, an electrostatic charge may be applied, if necessary. Among these, rotary atomization coating using an electrostatic charge is preferable.

The colored transparent paint preferably has a solids content of 1 to 50 mass %, and more preferably 3 to 40 mass %. The colored transparent paint preferably has a viscosity measured with a Brookfield-type viscometer at 20° C. of 50 to 7000 mPa·s, more preferably 60 to 6000 mPa·s, and even more preferably 100 to 5000 mPa·s.

The colored transparent paint can be applied by a method such as electrostatic spraying, air spray coating, or airless spray coating. The film thickness is preferably within the range of 3 to 50 μm and particularly preferably 5 to 40 μm, from the viewpoint of minimizing color change caused by the error of the thickness of the coating film.

In the method for forming a multilayer coating film of the present invention, a top clear paint can be applied to the uncured colored transparent coating film formed as above, to form a top clear coating film; however, an uncured colored transparent coating film obtained by applying a colored transparent paint can be heat-cured to form the uppermost coating film. The uncured colored transparent coating film is not limited to a coating film immediately after the application of the colored transparent paint, but includes a coating film that is allowed to stand at room temperature for 15 to 30 minutes after the application of the colored transparent paint and a coating film that is heated at 50 to 100° C. for 30 seconds to 10 minutes after the application of the colored transparent paint. The colored transparent coating film after heating preferably has a cured film thickness within a range of 3 to 50 μm, and more preferably 5 to 40 μm.

When the colored transparent coating film is formed as the uppermost layer, the colored transparent coating film requires functions necessary for the uppermost coating film, i.e., weather resistance and water resistance, in addition to the function of enhancing the chroma of the multilayer coating film to be formed. In this case, for the colored transparent coating film, a color clear paint obtained by further adding the color pigment to a top clear paint described below can be used. When the color clear paint is used as the colored transparent paint, its application and drying can be performed in the same manner as those of the top clear paint described below.

Top Clear Paint

In the method for forming a multilayer coating film of the present invention, a top clear paint can be applied to the uncured or cured colored transparent coating film. The top clear paint for use may be any known thermosetting clear coat paint compositions. Examples of the thermosetting clear coat paint composition include those containing a base resin having crosslinkable functional groups and a curing agent, such as organic solvent-based thermosetting paint compositions, aqueous thermosetting paint compositions, and powdery thermosetting paint compositions. The paint compositions listed as the clear paint above can also be used.

Examples of the crosslinkable functional groups contained in the base resin include a carboxyl group, a hydroxyl group, an epoxy group, a silanol group, and the like. Examples of the type of the base resin include acrylic resin, polyester resin, alkyd resin, urethane resin, epoxy resin, fluorine resin, and the like. Examples of the curing agent include polyisocyanate compounds, blocked polyisocyanate compounds, melamine resin, urea resin, carboxy-containing compounds, carboxy-containing resin, epoxy-containing resin, epoxy-containing compounds, and the like.

The combination of the base resin and the curing agent for the clear paint is preferably a carboxy-containing resin and an epoxy-containing resin, a hydroxy-containing resin and a polyisocyanate compound, a hydroxy-containing resin and a blocked polyisocyanate compound, a hydroxy-containing resin and melamine resin, and the like.

The clear paint may be a one-component paint or a multi-component paint, such as a two-component paint.

In particular, the clear paint is preferably a two-component clear paint containing the following hydroxy-containing resin and a polyisocyanate compound, in terms of the adhesion of the obtained coating film.

When a two-component clear paint containing a hydroxy-containing resin and an isocyanate-containing compound is used as the clear paint, a state in which the hydroxy-containing resin and the polyisocyanate compound are separately present is preferable in terms of storage stability. They are mixed and prepared into a two-component composition immediately before use.

When the one-component clear paint is used, the combination of the base resin and the curing agent for the one-component clear paint is a carboxy-containing resin and an epoxy-containing resin, a hydroxy-containing resin and a blocked polyisocyanate compound, a hydroxy-containing resin and melamine resin, and the like.

For details, please refer to the "Clear Paint" section.

The solids concentration of the top clear paint is preferably about 30 to 70 mass %, and more preferably about 40 to 60 mass %.

The coating of the top clear paint is not particularly limited, and the same method as those for the base paint may be used. For example, the top clear paint can be applied by a coating method, such as air spray coating, airless spray coating, rotary atomization coating, or curtain coating. In these coating methods, an electrostatic charge may be applied, if necessary. Of these, rotary atomization coating using an electrostatic charge is preferable. The coating amount of the top clear paint is generally preferably an amount in which the cured film thickness is about 10 to 50 μm.

Moreover, when the top clear paint is applied, it is preferable to suitably adjust the viscosity of the top clear paint within a viscosity range suitable for the coating method. For example, for rotary atomization coating using an electrostatic charge, it is preferable to suitably adjust the viscosity of the top clear paint within a range of about 15 to 60 seconds measured by a Ford cup No. 4 viscometer at 20° C. using a solvent, such as an organic solvent.

In the method for forming a multilayer coating film according to the present invention, when the top clear paint is applied to the uncured colored transparent coating film to form an uncured top clear coating film, these two coating films can be simultaneously cured by heating. Heating can be performed by a known means. For example, a drying furnace, such as a hot-blast stove, an electric furnace, or an infrared beam heating furnace, can be used. The heating temperature is preferably within the range of 70 to 150° C., and more preferably 80 to 140° C. The heating time is not particularly limited, but is preferably within the range of 10 to 40 minutes, and more preferably 20 to 30 minutes.

Graininess

The coating film obtained by the method for forming a multilayer coating film according to the present invention has low graininess and a delicate appearance; and has an HG value (a numerical value representing the graininess) of 10 to 40.

In the present specification, the "HG value" is defined as a numerical value measured using a microscopic brilliance measuring device. The "HG value" is a parameter of microscopic brilliance obtained by microscopic observation of a coating surface, and represents the graininess in the highlight. The HG value is calculated as follows. First, the coating surface is photographed with a CCD camera at an incident angle of 15° and a receiving angle of 0°, and the obtained digital image data (two-dimensional brilliance distribution data) is subjected to two-dimensional Fourier transformation to obtain a power spectrum image. Subsequently, only the spatial frequency area corresponding to graininess is extracted from the power spectrum image, and the obtained measurement parameter is converted to a numerical value from 0 to 100 that has a linear relation with graininess, thus obtaining an HG value. An HG value of 0 indicates no graininess of the effect pigment at all, and an HG value of 100 indicates the highest possible graininess of the effect pigment. The details of the measurement method are found in Research on Coatings (Kansai Paint Technical Report), No. 138, August 2002, pp. 8 to 24; and in Research on Coatings (Kansai Paint Technical Report), No. 132, August 2002, pp. 8 to 24.

Lightness in Highlight

The coating film obtained by the method for forming a multilayer coating film according to the present invention has high luminance in the highlight. Specifically, the brightness Y value (Y5) in the XYZ (Yxy) color space calculated based on the spectral reflectance of light illuminated at an angle of 45 degrees with respect to the coating film and received at an angle of 5 degrees deviated from the specular reflection light is within the range of 100 to 250. In the present specification, Y5 is defined as a numerical value obtained using a Conic-Spectrophotometric Color Measurement System GCMS-4 (trade name, produced by Murakami Color Research Laboratory Co., Ltd.).

Hue Angle

The method for forming a multilayer coating film according to the present invention is particularly effective for red-based paint colors. In the present specification, a red-based paint color is specifically defined as a paint color in which the hue angle h in the L*C*h color space diagram calculated based on the spectral reflectance of light illuminated at an angle of 45 degrees with respect to the coating film and received at an angle of 45 degrees deviated from the specular reflection light is within the range of −45 to 45° when the a* red direction is defined as 0°. The L*C*h color space is a color space devised from the L*a*b* color space, which was standardized in 1976 by the Commission Internationale de l'Eclairage, and also adopted in JIS Z 8729.

In the method for forming a multilayer coating film according to the present invention, when the hue angle is in the above range, a paint color in which the chroma, lightness, and index of depth-feeling C*45/L*45 are in the numerical ranges shown below can be obtained.

Chrome

The method for forming a multilayer coating film according to the present invention makes it possible to obtain a coating film in which the chroma C*45 in the L*C*h color space calculated based on the spectral reflectance of light illuminated at an angle of 45 degrees with respect to the formed multilayer coating film and received at an angle of 45 degrees deviated from the specular reflection light is within the range of 30 to 46. C*45 represents chroma, and is a numerical representation of the geometric distance from the center in the color space diagram. The larger the chrome C*45, the higher the chroma.

Lightness

The method for forming a multilayer coating film according to the present invention makes it possible to obtain a coating film in which the lightness L*45 in the L*a*b* color space calculated based on the spectral reflectance of light illuminated at an angle of 45 degrees with respect to the formed multilayer coating film and received at an angle of 45 degrees deviated from the specular reflection light is within the range of 5 to 20. The lightness L*45 represents lightness. A decrease in lightness near the face means that the lightness change is large compared with the lightness in the highlight.

Index of Depth-Feeling C*45/L*45

The method for forming a multilayer coating film according to the present invention makes it possible to obtain a coating film in Which the index of depth-feeling C*45/L*45, which is obtained by dividing the chrome C*45 by the lightness L*45 in the L*a*b* color space calculated based on the spectral reflectance of light illuminated at an angle of 45 degrees with respect to the formed multilayer coating film and received at an angle of 45 degrees deviated from the specular reflection light, is within the range of 1.0 to 6.0, preferably 1.1 to 5.0, and more preferably 2.4 to 4.0. A large value obtained by dividing chroma, which indicates the vividness of color, by lightness, which indicates brightness, means that the darkness is excellent.

The present invention may also have the following configurations.

(1) A method for forming a multilayer coating film comprising the steps of:

applying, to a substrate, an effect pigment dispersion that comprises water, a surface adjusting agent, a flake-effect pigment, and a rheology control agent, and that has a solids content within the range of 0.5 to 10 mass % to form an effect pigment-containing coating film; and applying a colored transparent paint to the effect pigment-containing coating film to form a colored transparent coating film having a total light transmittance at a wavelength of 400 nm to 700 nm of 20 to 70%.

(2) The method for forming a multilayer coating film according to (1), wherein the effect pigment-containing coating film has a dry film thickness of 0.02 to 5.0 μm.

(3) The method for forming a multilayer coating film according to (1) or (2), further comprising a step of applying a top clear paint to the colored transparent coating film to form a top clear coating film.

(4) The method for forming a multilayer coating film according to any one of (1) to (3), wherein the flake-effect pigment in the effect pigment dispersion comprises a vapor deposition metal flake pigment.

(5) The method for forming a multilayer coating film according to any one of (1) to (3), wherein the flake-effect pigment in the effect pigment dispersion comprises an aluminum flake pigment.

(6) The method for forming a multilayer coating film according to any one of (1) to (5), wherein the content of the flake-effect pigment in the effect pigment dispersion as a solids content is 0.2 to 8.0 parts by mass, based on 100 parts by mass of the effect pigment dispersion.

(7) The method for forming a multilayer coating film according to any one of (1) to (6), wherein the effect pigment dispersion further comprises a color pigment.

(8) The method for forming a multilayer coating film according to (7), wherein the color pigment is one or more members selected from the group consisting of composite metal oxide pigments, such as iron oxide pigments and titan yellow, azo pigments, quinacridone pigments, diketopyrrolopyrrole pigments, perylene pigments, perinone pigments, benzimidazolone pigments, isoindoline pigments, isoindolinone pigments, metal chelate azo pigments, phthalocyanine pigments, indanthrone pigments, dioxan pigments, threne pigments, indigo pigments, and carbon black pigments.

(9) The method for forming a multilayer coating film according to (7) or (8), wherein the color pigment is one or more members selected from the group consisting of perylene pigments, diketopyrrolopyrrole pigments, quinacridone pigments, and phthalocyanine pigments.

(10) The method for forming a multilayer coating film according to any one of (7) to (10), wherein the content of the color pigment in the effect pigment dispersion is 10 to 500 parts by mass, based on 100 parts by mass of the flake-effect pigment.

(11) The method for forming a multilayer coating film according to any one of (1) to (10), wherein the rheology control agent in the effect pigment dispersion is a cellulose-based rheology control agent.

(12) The method for forming a multilayer coating film according to any one of (1) to (11), wherein the rheology control agent in the effect pigment dispersion is a cellulose nanofiber.

(13) The method for forming a multilayer coating film according to any one of (1) to (12), wherein the content of the rheology control agent in the effect pigment dispersion is 2 to 150 parts by mass, based on 100 parts by mass of the flake-effect pigment.

(14) The method for forming a multilayer coating film according to any one of (1) to (9), wherein the surface adjusting agent is one or more members selected from the group consisting of silicone-based surface adjusting agents, acrylic-based surface adjusting agents, vinyl-based surface adjusting agents, and fluorine-based surface adjusting agents.

(15) The method for forming a multilayer coating film according to any one of (1) to (14), wherein the content of the surface adjusting agent in the effect pigment dispersion as a solids content is 0.01 to 4.0 parts by mass, based on 100 parts by mass of the effect pigment dispersion.

(16) The method for forming a multilayer coating film according to any one of (1) to (15), wherein the colored transparent paint comprises a color pigment.

(17) The method for forming a multilayer coating film according to (16), wherein the color pigment is one or more members selected from the group consisting of azo pigments, quinacridone pigments, diketopyrrolopyrrole pigments, perylene pigments, perinone pigments, benzimidazolone pigments, isoindoline pigments, isoindolinone pigments, metal chelate azo pigments, phthalocyanine pigments, indanthrone pigments, dioxazine pigments, threne pigments, indigo pigments, and carbon black pigments.

(18) The method for forming a multilayer coating film according to any one of (1) to (17), wherein the multilayer coating film has a graininess of 10 to 40.

(19) The method for forming a multilayer coating film according to any one of (1) to (18), when the brightness Y value (Y5) in the XYZ (Yxy) color space calculated based on the spectral reflectance of light illuminated at an angle of 45 degrees with respect to the multilayer coating film and received at an angle of 5 degrees deviated from the specular reflection light is within the range of 100 to 250.

(20) The method for forming a multilayer coating film according to any one of (1) to (19), wherein the hue angle h in the L*C*h color space diagram calculated based on the spectral reflectance of light illuminated at an angle of 45 degrees with respect to the multilayer coating film and received at an angle of 45 degrees deviated from the specular reflection light is within the range of −45 to 45° when the a* red direction is defined as 0°.

(21) The method for forming a multilayer coating film according to any one of (1) to (20), wherein the chroma C*45 in the L*C*h color space calculated based on the spectral reflectance of light illuminated at an angle of 45 degrees with respect to the multilayer coating film and received at an angle of 45 degrees deviated from the specular reflection light is within the range of 30 to 46.

(22) The method for forming a multilayer coating film according to any one of (1) to (21), wherein the lightness L*45 in the L*a*b* color space calculated based on the spectral reflectance of light illuminated at an angle of 45 degrees with respect to the multilayer coating film and received at an angle of 45 degrees deviated from the specular reflection light is within the range of 5 to 20.

(23) The method for forming a multilayer coating film according to any one of (1) to (22), wherein the index of depth-feeling C*45/L*45 is 1.0 to 6.0, the index of depth-feeling C*45/L*45 being obtained by dividing the chroma C*45 by the lightness L*45 in the L*a*b* color space calculated based on the spectral reflectance of light illuminated at an angle of 45 degrees with respect to the multilayer coating film and received at an angle of 45 degrees deviated from the specular reflection light.

EXAMPLES

The present invention is described in more detail below with reference to Production Examples, Examples, and Comparative Examples. However, the present invention is not limited thereto. In the examples, "parts" and "%" are expressed on a mass basis, unless otherwise specified. The thickness of the coating film is based on the cured coating film.

Production of Acrylic Resin Aqueous Dispersion

Production Example 1

128 parts of deionized water and 2 parts of "Adeka Reasoap SR-1025" (trade name, produced by Adeka, an emulsifier, active ingredient: 25%) were placed in a reaction vessel equipped with a thermometer, a thermostat, a stirrer, a reflux condenser, a nitrogen inlet tube, and a dropping funnel. The mixture was stirred and mixed in a nitrogen flow, and heated to 80° C.

Subsequently, 1% of the entire amount of monomer emulsion for the core portion, which is described below, and 5.3 parts of a 6% ammonium persulfate aqueous solution were introduced into the reaction vessel; and maintained therein at 80° C. for 15 minutes. Thereafter, the remaining monomer emulsion for the core portion was added dropwise over a period of 3 hours to the reaction vessel maintained at the same temperature. After completion of the dropwise addition, the mixture was aged for 1 hour. Subsequently, a monomer emulsion for the shell portion, which is described below, was added dropwise over a period of 1 hour, followed by aging for 1 hour. Thereafter, the mixture was cooled to 30° C. while gradually adding 40 parts of a 5% 2-(dimethylamino)ethanol aqueous solution to the reaction vessel; and filtered through a 100-mesh nylon cloth, thereby obtaining an acrylic resin aqueous dispersion (R-1) having an average particle size of 100 nm and a solids content of 30%. The obtained acrylic resin aqueous dispersion had an acid value of 33 mg KOH/g, and a hydroxy value of 25 mg KOH/g.

A monomer emulsion for the core portion: 40 parts of deionized water, 2.8 parts of "Adeka Reasoap SR-1025," 2.1 parts of methylene bisacrylamide, 2.8 parts of styrene, 16.1 parts of methyl methacrylate, 28 parts of ethyl acrylate, and 21 parts of n-butyl acrylate were mixed and stirred, thereby obtaining a monomer emulsion for the core portion.

A monomer emulsion for the shell portion: 17 parts of deionized water, 1.2 parts of "Adeka Reasoap SR-1025," 0.03 parts of ammonium persulfate, 3 parts of styrene, 5.1 parts of 2-hydroxyethyl acrylate, 5.1 parts of methacrylic acid, 6 parts of methyl methacrylate, 1.8 parts of ethyl acrylate, and 9 parts of n-butyl acrylate were mixed and stirred, thereby obtaining a monomer emulsion for the shell portion.

Production of Acrylic Resin Solution

Production Example 2

35 parts of propylene glycol monopropyl ether was placed into a reaction vessel equipped with a thermometer, a thermostat, a stirrer, a reflux condenser, a nitrogen inlet tube, and a dropping funnel; and heated to 85° C. Subsequently, a mixture comprising 30 parts of methyl methacrylate, 20 parts of 2-ethylhexyl acrylate, 29 parts of n-butyl acrylate, 15 parts of 2-hydroxyethyl acrylate, 6 parts of acrylic acid, 15 parts of propylene glycol monopropyl ether, and 2.3 parts of 2,2'-azobis(2,4-dimethylvaleronitrile) was added dropwise thereto over a period of 4 hours. After completion of the dropwise addition, the mixture was aged for 1 hour. Subsequently, a mixture of 10 parts of propylene glycol monopropyl ether and 1 part of 2,2'-azobis(2,4-dimethylvaleronitrile) was further added dropwise thereto over a period of 1 hour. After completion of the dropwise addition, the mixture was aged for 1 hour. 7.4 parts of diethanolamine was further added thereto, thereby obtaining an acrylic resin solution (R-2) having a solids content of 55%. The obtained hydroxy-containing acrylic resin had an acid value of 47 mg KOH/g, a hydroxy value of 72 mg KOH/g, and a weight average molecular weight of 58000.

Production of Polyester Resin Solution

Production Example 3

109 parts of trimethylolpropane, 141 parts of 1,6-hexanediol, 126 parts of 1,2-cyclohexanedicarboxylic acid anhydride, and 120 parts of adipic acid were placed into a reaction vessel equipped with a thermometer, a thermostat, a stirrer, a reflux condenser, and a water separator. The mixture was heated from 160 to 230° C. over a period of 3 hours, followed by a condensation reaction at 230° C. for 4 hours. Subsequently, to introduce a carboxyl group to the obtained condensation reaction product, 38.3 parts of trimellitic anhydride was added to the product, followed by a reaction at 170° C. for 30 minutes. Thereafter, the product was diluted with 2-ethyl-1-hexanol, thereby obtaining a polyester resin solution (R-3) having a solids content of 70%. The obtained hydroxy-containing polyester resin had an acid value of 46 mg KOH/g, a hydroxy value of 150 mg KOH/g, and a number average molecular weight of 1400.

Production of Phosphate Group-Containing Resin Solution

Production Example 4

A mixed solvent of 27.5 parts of methoxy propanol and 27.5 parts of isobutanol was placed in a reaction vessel equipped with a thermometer, a thermostat, a stirrer, a reflux condenser, and a dropping funnel; and heated to 110° C. While the temperature was maintained at 110° C., 121.5 parts of a mixture comprising 25 parts of styrene, 27.5 parts of n-butyl methacrylate, 20 parts of branched higher alkyl acrylate (trade name: "Isostearyl Acrylate," produced by Osaka Organic Chemical Industry Ltd.), 7.5 parts of 4-hydroxybutyl acrylate, 15 parts of a phosphate group-containing polymerizable monomer described below, 12.5 parts of 2-methacryloyloxyethyl acid phosphate, 10 parts of isobutanol, and 4 parts of tert-butylperoxy octanoate was added dropwise to the above mixed solvent over a period of 4 hours. Further, a mixture comprising 0.5 parts of tert-butylperoxy octanoate and 20 parts of isopropanol was added dropwise for 1 hour. Then, the resultant was stirred and aged for 1 hour, thereby obtaining a phosphate group-containing resin solution (R-4) having a solids content of 50%. The phosphate group-containing resin solution (R-4) had an acid value of 83 mg KOH/g, a hydroxy value of 29 mg KOH/g, and a weight average molecular weight of 10000.

A phosphate group-containing polymerizable monomer: 57.5 parts of monobutyl phosphoric acid and 41 parts of isobutanol were placed in a reaction vessel equipped with a thermometer, a thermostat, a stirrer, a reflux condenser, and a dropping funnel; and heated to 90° C. After 42.5 parts of glycidyl methacrylate was added dropwise over a period of 2 hours, the mixture was further stirred and aged for 1 hour. Thereafter, 59 parts of isopropanol was added, thereby obtaining a phosphate group-containing polymerizable monomer solution having a solids content of 50%. The acid value of the obtained monomer was 285 mg KOH/g.

Production of Extender Pigment Dispersion P-1

Production Example 5

In a glass dispersion vessel, 327 parts (solids content: 60 parts) of the acrylic resin solution (R-2), 360 parts of deionized water, 6 parts of Surfynol 104A (trade name, produced by Air Products, an antifoaming agent, solids content: 50%), and 250 parts of Barifine BF-20 (trade name, produced by Sakai Chemical Industry Co., Ltd., a barium sulfate powder, average particle size: 0.03 μm) were mixed; and a glass bead medium was added thereto. The mixture was mixed and dispersed using a shaker-type paint conditioner at room temperature for 1 hour; and the glass bead medium was removed, thereby obtaining an extender pigment dispersion (P-1) having a solids content of 44 mass %.

Production of Color Pigment Dispersion

Production Example 6

In a glass dispersion vessel, 327 parts (solids content: 180 parts) of the acrylic resin solution (R-2), 500 parts of "Titanix JR-806" (trade name, produced by Tayca Corporation, titanium oxide), 5 parts of "MA-100" (trade name, produced by Mitsubishi Chemical Corporation, carbon black), and 500 parts of deionized water were mixed. After the pH of the mixture was adjusted to 8.2 using 2-(dimethylamino)ethanol, a zirconia bead medium with a diameter of about 3 mm was added thereto. The mixture was mixed and dispersed using a shaker-type paint conditioner at room temperature for 30 minutes; and the zirconia bead medium was removed, thereby obtaining a color pigment dispersion (P-2) having a solids content of 51 mass %.

Production Example 7

In a glass dispersion vessel, 18.2 parts (resin solids content: 10 parts) of the acrylic resin solution (R-2), 15 parts of "Paliogen Maroon L3920" (trade name, a perylene maroon pigment, produced by BASF), and 50 parts of deionized water were mixed. After the pH of the mixture was adjusted to 8.2 using 2-(dimethylamino)ethanol, a zirconia bead medium with a diameter of 0.5 mm was added thereto. The mixture was mixed and dispersed using a shaker-type paint conditioner at room temperature for 30 minutes; and the zirconia bead medium was removed, thereby obtaining a color pigment dispersion (P-3) having a solids content of 30 mass %.

Production Example 8

A color pigment dispersion (P-4) was obtained in the same manner as in Production Example 7, except that "Magenta L4540" (trade name, a quinacridone red pigment, produced by BASF) was used in place of "Paliogen Maroon L3920" (trade name, a perylene maroon organic pigment, produced by BASF).

Production Example 9

A color pigment dispersion (P-5) was obtained in the same manner as in Production Example 7, except that "Monolite Red 326401" (trade name, a diketopyrrolopyrrole red pigment, produced by Heubach) was used in place of "Paliogen Maroon 13920" (trade name, a perylene maroon organic pigment, produced by BASF).

Production Example 10

A color pigment dispersion (P-6) was obtained in the same manner as in Production Example 7, except that "Perrindo Maroon 179 229-6438" (trade name, a perylene maroon organic pigment, produced by DIC) was used in place of "Paliogen Maroon 13920" (trade name, a perylene maroon organic pigment, produced by BASF).

Production Example 11

In a glass dispersion vessel, 33.3 parts of "Acrydic A430-60" (trade name, an acrylic resin solution, solids content: 60 mass %, produced by DIC), 3 parts of Solsperse 24000GR (trade name, a pigment dispersant, produced by Lubrizol), 15 parts of "Perrindo Maroon 179 229-6440" (trade name, a perylene maroon organic pigment, produced by DIC), and 61.7 parts of ethylene glycol monoethyl ether acetate were mixed; and a zirconia bead medium with a diameter of 0.5 mm was further added thereto. The mixture was mixed and dispersed using a shaker-type paint conditioner at room temperature for 5 hours; and the zirconia bead medium was removed, thereby obtaining a color pigment dispersion (P-7) having a solids content of 36 mass %.

Production of High-Concentration Aluminum Pigment Liquid

Production Example 12

12.7 parts (solids content: 10 parts) of aluminum paste GX-3110 (trade name, an aluminum flake pigment, solids content: 79 mass %, average particle size: 11 μm, produced by Asahi Kasei Corporation, non-leafing type), 8 parts (solids content: 4 parts) of the phosphate group-containing resin solution (R-4), 39.3 parts of 2-ethyl-1-hexanol (mass dissolved in 100 g of water at 20° C.: 0.1 g), and 0.5 parts of 2-(dimethylamino)ethanol were homogeneously mixed in a stainless steel beaker, thereby obtaining a high-concentration aluminum pigment liquid (E-1).

Production Example 13

14.7 parts (solids content: 10 parts) of aluminum paste GX-3050 (trade name, an aluminum flake pigment, solids content: 68 mass %, average particle size: 16 μm, produced by Asahi Easel Corporation, non-leafing type), 8 parts (solids content: 4 parts) of the phosphate group-containing resin solution (R-4), 37.3 parts of 2-ethyl-1-hexanol (mass dissolved in 100 g of water at 20° C.: 0.1 g), and 0.5 parts of 2-(dimethylamino)ethanol were homogeneously mixed in a stainless steel beaker, thereby obtaining a high-concentration aluminum pigment liquid (E-2).

Production Example 14

14.7 parts (solids content: 10 parts) of aluminum paste MH-8805 (trade name, an aluminum flake pigment, solids content: 68 mass %, average particle size: 17 μm, produced by Asahi Kasei Corporation, non-leafing type), 8 parts (solids content: 4 parts) of the phosphate group-containing resin solution (R-4), 37.3 parts of 2-ethyl-1-hexanol (mass dissolved in 100 g of water at 20° C.: 0.1 g), and 0.5 parts of 2-(dimethylamino)ethanol were homogeneously mixed in a stainless steel beaker, thereby obtaining a high-concentration aluminum pigment liquid (E-3).

Production Example 15

13.5 parts (solids content: 10 parts) of aluminum paste GX-3100 (trade name, an aluminum flake pigment, solids content: 74 mass %, average particle size: 10 μm, produced by Asahi Kasei Corporation, non-leafing type), 8 parts (solids content: 4 parts) of the phosphate group-containing resin solution (R-4), 38.5 parts of 2-ethyl-1-hexanol (mass dissolved in 100 g of water at 20° C.: 0.1 g), and 0.5 parts of 2-(dimethylamino)ethanol were homogeneously mixed in a stainless steel beaker, thereby obtaining a high-concentration aluminum pigment liquid (E-4).

Production Example 16

15.4 parts (solids content: 10 parts) of Paliocrom Orange L2800 (trade name, an iron oxide-coated aluminum flake pigment, solids content: 65 mass %, average particle size: 11 μm, produced by BASE, non-leafing type), 8 parts (solids content: 4 parts) of the phosphate group-containing resin solution (R-4), 36.6 parts of 2-ethyl-1-hexanol (mass dissolved in 100 g of water at 20° C.: 0.1 g), and 0.5 parts of 2-(dimethylamino)ethanol were homogeneously mixed in a stainless steel beaker, thereby obtaining a high-concentration aluminum pigment liquid (E-5).

Production of Base Paint

Production of Transparent Base Paint (X-1)

Production Example 17

In a stirring vessel, 14 parts (on a solids basis) of the extender pigment dispersion (P-1), 40 parts (on a solids basis) of the acrylic resin aqueous dispersion (R-1), 23 parts (on a solids basis) of the polyester resin solution (R-3), 10 parts (on a solids basis) of "U-COAT UX-485" (trade name, produced by Sanyo Chemical Industries, Ltd., a polycarbonate-based urethane resin aqueous dispersion, solids content: 40%), and 27 parts (on a solids basis) of "Cymel 251" (trade name, produced by Nihon Cytec Industries Inc., a melamine resin, solids content: 80%) were stirred and mixed, thereby preparing a transparent base paint (X-1).

Production of Colored Base Paint (X-2)

Production Example 18

In a stirring vessel, 23 parts (on a solids basis) of the color pigment dispersion (P-2), 40 parts (on a solids basis) of the acrylic resin aqueous dispersion (R-1), 23 parts (on a solids basis) of the polyester resin solution (R-3), 10 parts (on a solids basis) of "U-COAT UX-485" (trade name, produced by Sanyo Chemical Industries, Ltd., a polycarbonate-based urethane resin aqueous dispersion, solids content: 40%), and 27 parts (on a solids basis) of "Cymel 251" (trade name, produced by Nihon Cytec Industries Inc., a melamine resin, solids content: 80%) were stirred and mixed, thereby preparing a colored base paint (X-2).

Production of Metallic Base Paint 1 (X-3)

Production Example 19

In a stirring vessel, 4 parts (on an aluminum solids basis) of the high-concentration aluminum pigment liquid (E-1), 4 parts (on an aluminum solids basis) of the high-concentration aluminum pigment liquid (E-2), 7 parts (on an aluminum solids basis) of the high-concentration aluminum pigment liquid (E-3), 10 parts (on a solids basis) of "U-COAT UX-485" (trade name, produced by Sanyo Chemical Industries, Ltd., a polycarbonate-based urethane resin aqueous dispersion, solids content: 40%), and 27 parts (on a solids basis) of "Cymel 251" (trade name, produced by Nihon Cytec Industries Inc., a melamine resin, solids content: 80%) were stirred and mixed. Dimethylethanolamine and deionized water were added thereto; and the mixture was adjusted to have a pH of 8.0 and a viscosity of 700 MPa·s measured by a Brookfield-type viscometer at a rotor rotational speed of 60 rpm, thereby preparing a metallic base paint 1 (X-3) having a solids content of about 25 mass %.

Production of Metallic Base Paint 2 (X-4)

Production Example 20

In a stirring vessel, 30 parts (on an aluminum solids basis) of the high-concentration aluminum pigment liquid (E-4), 25 parts (on a pigment solids basis) of the color pigment dispersion (P-3), 40 parts (on a solids basis) of the acrylic resin aqueous dispersion (R-1), 23 parts (on a solids basis) of the polyester resin solution (R-3), 10 parts (on a solids basis) of "U-COAT UX-485" (trade name, produced by Sanyo Chemical Industries, Ltd., a polycarbonate-based urethane resin aqueous dispersion, solids content: 40%), and 27 parts (on a solids basis) of "Cymel 251" (trade name, produced by Nihon Cytec Industries Inc., a melamine resin, solids content: 80%) were stirred and mixed. Dimethylethanolamine and deionized water were added thereto; and the mixture was adjusted to have a pH of 8.0 and a viscosity of 700 mPa·s measured by a Brookfield-type viscometer at a rotor rotational speed of 60 rpm, thereby preparing a metallic base paint 2 (X-4) having a solids content of about 25 mass %.

Production of Metallic Base Paint 3 (X-5)

Production Example 21

In a stirring vessel, 5 parts (on an aluminum solids basis) of the high-concentration aluminum pigment liquid (E-5), 1 part (on a pigment solids basis) of the color pigment dispersion (P-4), 6 parts (on a pigment solids basis) of the color pigment dispersion (P-5), 7 parts (on a pigment solids basis) of "Xirallic T60-21 NUT Solaris Red" (trade name, a titanium oxide-coated alumina flake pigment, produced by Merck), 40 parts (on a solids basis) of the acrylic resin aqueous dispersion (R-1), 23 parts (on a solids basis) of the polyester resin solution (R-3), 10 parts (on a solids basis) of "U-COAT UX-485" (trade name, produced by Sanyo Chemical Industries, Ltd., a polycarbonate-based urethane resin aqueous dispersion, solids content: 40%), and 27 parts (on a solids basis) of "Cymel 251" (trade name, produced by Nihon Cytec Industries Inc., a melamine resin, solids content: 80%) were stirred and mixed. Dimethylethanolamine and deionized water were added thereto; and the mixture was adjusted to have a pH of 8.0 and a viscosity of 700 mPa·s measured by a Brookfield-type viscometer at a rotor rotational speed of 60 rpm, thereby preparing a metallic base paint 3 (X-5) having a solids content of about 25 mass %.

Production of Effect Pigment Dispersion

Production Example 22

Production of Effect Pigment Dispersion (Y-1)

56.5 parts of distilled water, 1 part of a surface adjusting agent A-1 (Note 1), 12.5 parts (solids content: 1.25 parts) of "Hydroshine WS-3004" (trade name, an aqueous vapor deposition aluminum flake pigment, produced by Eckart, solids content: 10%, internal solvent: isopropanol, average particle size D50: 13 μm, thickness: 0.05 μm; the surface was treated with silica), 30 parts (solids content: 0.6 parts) of "Rheocrysta" (trade name, a cellulose based rheology control agent=cellulose nanofiber gel, produced by DKS Co. Ltd., solids content: 2%), and 0.02 parts of dimethylethanolamine were blended, stirred, and mixed, thereby preparing an effect pigment dispersion (Y-1).

Note 1: surface adjusting agent A-1: "BYK348" (trade name, silicone-based surface adjusting agent, produced by BYK) Contact angle=13°, dynamic surface tension (mN/m) =63.9, static surface tension (mN/m)=22.2, and lamellar length=7.45 mm; the contact angle refers to a contact angle with respect to a tin plate measured in such a manner that a liquid prepared by mixing isopropanol, water, and the surface adjusting agent (A-1) at a mass ratio of 4.5/95/1 was adjusted to have a viscosity of 100 mPa·s measured by a Brookfield-type viscometer at a rotor rotational speed of 60 rpm at a temperature of 20° C., 10 μL of the liquid was added dropwise to a previously degreased tin plate (produced by Paltek Corporation), and the contact angle with respect to the tin plate was measured by a contact angle meter (CA-X150, trade name, produced by Kyowa Interface Science Co., Ltd.) 10 seconds after the dropwise addition.

Production Examples 23 to 27

Production of Effect Pigment Dispersions (Y-2 to Y-6)

Effect pigment dispersions (Y-2 to Y-6) were obtained in the same manner as in Production Example 22, except that the formulations shown in Table 1 were used.

TABLE 1

| | Effect pigment dispersion Y-1 | Effect pigment dispersion Y-2 | Effect pigment dispersion Y-3 | Effect pigment dispersion Y-4 | Effect pigment dispersion Y-5 | Effect pigment dispersion Y-6 |
|---|---|---|---|---|---|---|
| Distilled water | 56.5 | 54.0 | 59 | 84.8 | 56.5 | 56.5 |
| Surface adjusting agent A-1 | 1.0 | 1.0 | 1.0 | 1.0 | 1.0 | 1.0 |
| Vapor deposition aluminum flake pigment*1 | 12.5 | 15.0 | 10.0 | 12.5 | 12.5 | 12.5 |
| Color pigment dispersion P-3 | — | — | — | — | 3.5 | 6.9 |

TABLE 1-continued

| | Effect pigment dispersion Y-1 | Effect pigment dispersion Y-2 | Effect pigment dispersion Y-3 | Effect pigment dispersion Y-4 | Effect pigment dispersion Y-5 | Effect pigment dispersion Y-6 |
|---|---|---|---|---|---|---|
| ASE-60 | — | — | — | 1.7 | — | — |
| Dimethylethanolamine | 0.02 | 0.02 | 0.02 | 0.02 | 0.02 | 0.02 |
| Rheocrysta (2%) | 30.0 | 30.0 | 30.0 | — | 30.0 | 30.0 |

*1Hydroshine WS-3004 (trade name, an aqueous vapor deposition aluminum flake pigment, produced by Eckart, solids content: 10%, internal solvent: isopropanol, average particle size D50.: 13 μm, thickness: 0.05 μm; the surface was treated with silica)

Production of Colored Transparent Paint

Production of Colored Transparent Paint 1 (C-1)

Production Example 28

In a stirring vessel, 3.3 parts (on a pigment solids basis) of the color pigment dispersion (P-3), 0.7 parts (on a pigment solids basis) of the color pigment dispersion (P-4), 40 parts (on a solids basis) of the acrylic resin aqueous dispersion (R-1), 23 parts (on a solids basis) of the polyester resin solution (R-3), 10 parts (on a solids basis) of "U-COAT UX-485" (trade name, produced by Sanyo Chemical Industries, Ltd., a polycarbonate-based urethane resin aqueous dispersion, solids content: 40%), and 27 parts (on a solids basis) of "Cymel 251" (trade name, produced by Nihon Cytec Industries Inc., a melamine resin, solids content: 80%) were stirred and mixed, thereby preparing a colored transparent paint (C-1).

Production of Colored Transparent Paint 2 (C-2)

Production Example 29

In a stirring vessel, 3 parts (on a pigment solids basis) of the color pigment dispersion (P-6), 40 parts (on a solids basis) of the acrylic resin aqueous dispersion (R-1), 23 parts (on a solids basis) of the polyester resin solution (R-3), 10 parts (on a solids basis) of "U-COAT UX-485" (trade name, produced by Sanyo Chemical Industries, Ltd., a polycarbonate-based urethane resin aqueous dispersion, solids content: 40%), and 27 parts (on a solids basis) of "Cymel 251" (trade name, produced by Nihon Cytec Industries Inc., a melamine resin, solids content: 80%) were stirred and mixed, thereby preparing a colored transparent paint 2 (C-2).

Production of Colored Transparent Paint 3 (C-3)

Production Example 30

In a stirring vessel, 3.96 parts (on a pigment solids basis) of the color pigment dispersion (P-3), 0.8 parts (on a pigment solids basis) of the color pigment dispersion (P-4), 40 parts (on a solids basis) of the acrylic resin aqueous dispersion (R-1), 23 parts (on a solids basis) of the polyester resin solution (R-3), 10 parts (on a solids basis) of "U-COAT UX-485" (trade name, produced by Sanyo Chemical Industries, Ltd., a polycarbonate-based urethane resin aqueous dispersion, solids content: 40%), and 27 parts (on a solids basis) of "Cymel 251" (trade name, produced by Nihon Cytec Industries Inc., a melamine resin, solids content: 80%) were stirred and mixed, thereby preparing a colored transparent paint (C-3).

Production of Colored Transparent Paint 4 (C-4)

Production Example 31

In a stirring vessel, 2.63 parts (on a pigment solids basis) of the color pigment dispersion (P-3), 0.56 parts (on a pigment solids basis) of the color pigment dispersion (P-4), 40 parts (on a solids basis) of the acrylic resin aqueous dispersion (R-1), 23 parts (on a solids basis) of the polyester resin solution (R-3), 10 parts (on a solids basis) of "U-COAT UX-485" (trade name, produced by Sanyo Chemical Industries, Ltd., a polycarbonate-based urethane resin aqueous dispersion, solids content: 40%), and 27 parts (on a solids basis) of "Cymel 251" (trade name, produced by Nihon Cytec Industries Inc., a melamine resin, solids content: 80%) were stirred and mixed, thereby preparing a colored transparent paint (C-4).

Production of Colored Transparent Paint 5 (C-5)

Production Example 32

In a stirring vessel, 9.9 parts (on a pigment solids basis) of the color pigment dispersion (P-3), 2.1 parts (on a pigment solids basis) of the color pigment dispersion (P-4), 40 parts (on a solids basis) of the acrylic resin aqueous dispersion (R-1), 23 parts (on a solids basis) of the polyester resin solution (R-3), 10 parts (on a solids basis) of "U-COAT UX-485" (trade name, produced by Sanyo Chemical Industries, Ltd., a polycarbonate-based urethane resin aqueous dispersion, solids content: 40%), and 27 parts (on a solids basis) of "Cymel 251" (trade name, produced by Nihon Cytec industries Inc., a melamine resin, solids content: 80%) were stirred and mixed, thereby preparing a colored transparent paint (C-5).

Production of Colored Transparent Paint 6 (C-6)

Production Example 33

In a stirring vessel, 1.65 parts (on a pigment solids basis) of the color pigment dispersion (P-3), 0.35 parts (on a pigment solids basis) of the color pigment dispersion (P-4), 40 parts (on a solids basis) of the acrylic resin aqueous dispersion (R-1), 23 parts (on a solids basis) of the polyester resin solution (R-3), 10 parts (on a solids basis) of "U-COAT UX-485" (trade name, produced by Sanyo Chemical Industries, Ltd., a polycarbonate-based urethane resin aqueous dispersion, solids content: 40%), and 27 parts (on a solids basis) of "Cymel 251" (trade name, produced by Nihon Cytec Industries Inc., a melamine resin, solids content: 80%) were stirred and mixed, thereby preparing a colored transparent paint (C-6).

Production of Colored Transparent Paint 7 (C-7: Color Clear Paint)

Production Example 34

The color pigment dispersion (P-7) was added to "KINO6510" clear paint (trade name, produced by Kansai Paint Co., Ltd., a hydroxy/isocyanate curable acrylic resin and urethane resin-based two-component organic solvent-based paint); and the mixture was stirred and mixed, thereby preparing a colored transparent paint (C-7) containing the pigment in an amount of 1 part by mass (on a solids basis) based on 100 parts by mass of the total resin solids content. The colored transparent paint (C-7) is a color clear paint.

Preparation of Substrate

Substrate 1

"Elecron GT-10" cationic electrodeposition paint (trade name, produced by Kansai Paint Co., Ltd., an epoxy resin polyamine-based cationic resin containing a blocked polyisocyanate compound as a crosslinking agent) was applied by electrodeposition to a degreased and zinc phosphate-treated steel plate (JISG3141 size: 400 mm×300 mm×0.8 mm) to a film thickness of 20 μm when cured. After the resulting film was heated at 170° C. for 20 minutes to be cured by crosslinking, an electrodeposition coating film was formed, thereby obtaining a substrate 1.

Substrate 2

"Elecron GT-10" cationic electrodeposition paint (trade name, produced by Kansai Paint Co., Ltd., an epoxy resin polyamine-based cationic resin containing a blocked polyisocyanate compound as a crosslinking agent) was applied by electrodeposition to a degreased and zinc phosphate-treated steel plate (JISG3141, size: 400 mm×300 mm×0.8 mm) to a film thickness of 20 μm when cured. The resulting film was heated at 170° C. for 20 minutes to be cured by crosslinking, thereby forming an electrodeposition coating film.

"TP-65 No. 8110" (trade name, produced by Kansai Paint Co., Ltd., a polyester resin-based solvent-based intermediate paint, L* value of the coating film to be obtained: 20) was applied to the surface of the obtained electrodeposition coating film of the steel plate to a cured film thickness of 30 μm by electrostatic spraying using a rotary atomization-type bell-shaped coating device. After the resulting film was heated at 140° C. for 30 minutes to be cured by crosslinking, an intermediate coating film was formed, thereby obtaining a substrate 2.

Production of Test Plate

Example 1

The transparent base paint (X-1) was applied to the substrate 2 to a film thickness of 10 μm when cured using a rotary atomization electrostatic coating device, and allowed to stand for 3 minutes. Thereafter, the resultant was preheated at 80° C. for 3 minutes to form an uncured base coating film.

The effect pigment dispersion (Y-1) prepared as described above was applied to the obtained uncured base coating film to a dry film thickness of 1.0 μm using a robot bell (produced by ABB) at a booth temperature of 23° C. and at a humidity of 68%; allowed to Stand for 3 minutes; and then allowed to stand at 80° C. for 3 minutes, thereby forming an uncured effect pigment-containing coating film.

Further, "KINO6510" clear paint (Z-1) (trade name, produced by Kansai Paint Co., Ltd., a hydroxy/isocyanate curable acrylic resin and urethane resin-based two-component organic solvent-based paint) was applied to the obtained uncured effect pigment-containing coating film to a dry film thickness of 35 μm using a robot bell (produced by ABB) at a booth temperature of 23° C. and at a humidity of 68% to form an uncured clear coating film. After coating, the resultant was allowed to stand at room temperature for 7 minutes. After heating in a hot-air circulation-type dryer at 140° C. for 30 minutes to simultaneously dry the three coating films, a multilayer coating film was formed.

Subsequently, the colored transparent paint (C-1) was applied to the multilayer coating film to a film thickness of 15 μm when cured using a rotary atomization electrostatic coating device, and allowed to stand for 3 minutes. Thereafter, the resultant was preheated at 80° C. for 3 minutes to form an uncured colored transparent coating film.

Further, "KINO6510" clear paint (Z-1) (trade name, produced by Kansai Paint Co., Ltd., a hydroxy/isocyanate curable acrylic resin and urethane resin-based two-component organic solvent-based paint) was applied to the obtained uncured colored transparent coating film to a dry film thickness of 35 μm using a robot bell (produced by ABB) at a booth temperature of 23° C. and at a humidity of 68% to form a clear coating film. After coating, the resultant was allowed to stand at room temperature for 7 minutes. After heating in a hot-air circulation-type dryer at 140° C. for 30 minutes to simultaneously dry the three coating films, a multilayer coating film was formed, thereby preparing a test plate.

The dry film thickness of the effect pigment-containing coating film was calculated from the following formula (3). The same applies to the following Examples and Comparative Examples.

$$x = sc/sg/S*10000 \quad (3)$$

x: film thickness [μm]

sc: coating solids content [g]

sg: coating film specific gravity [g/cm$^3$]

S: evaluation area of coating solids content [cm$^2$]

Examples 2 to 11 and Comparative Examples 4 to 7

Multilayer coating films were formed, thereby preparing test plates in the same manner as in Example 1, except that the coating-film structures shown in Table 2 were adopted.

TABLE 2

| Substrate | | Example 1 Substrate 2*1 | Example 2 Substrate 2 | Example 3 Substrate 2 | Example 4 Substrate 2 | Example 5 Substrate 2 | Example 6 Substrate 2 | Example 7 Substrate 2 |
|---|---|---|---|---|---|---|---|---|
| Intermediate paint | Type | TP-65 No. 8110 | TP-65 No. 8110 | TP-65 No. 8110 | TP-65 No. 8110 | TP-65 No. 8110 | TP-65 No. 8110 | TP-65 No. 8110 |
| | Film thickness: μm | 30 | 30 | 30 | 30 | 30 | 30 | 30 |
| Base paint | Type | X-1 | X-1 | X-1 | X-1 | X-2 | X-1 | X-1 |
| | Film thickness: μm | 10 | 10 | 10 | 10 | 10 | 10 | 10 |
| Effect pigment dispersion | Type | Y-1 | Y-2 | Y-3 | Y-4 | Y-1 | Y-5 | Y-6 |
| | Film thickness: μm | 1.0 | 1.0 | 1.0 | 1.0 | 1.0 | 1.0 | 1.0 |

TABLE 2-continued

| | | | | | | | | |
|---|---|---|---|---|---|---|---|---|
| Clear paint | Type | KINO6510 | KINO6510 | KINO6510 | KINO6510 | KINO6510 | KINO6510 | KINO6510 |
| | Film thickness: μm | 35 | 35 | 35 | 35 | 35 | 35 | 35 |
| Colored transparent paint | Type | C-1 | C-1 | C-1 | C-1 | C-1 | C-1 | C-1 |
| | Film thickness: μm | 15 | 15 | 15 | 15 | 15 | 15 | 15 |
| | Light transmittance: % | 32 | 32 | 32 | 32 | 32 | 32 | 32 |
| Top clear paint | Type | KINO6510 | KINO6510 | KINO6510 | KINO6510 | KINO6510 | KINO6510 | KINO6510 |
| | Film thickness: μm | 35 | 35 | 35 | 35 | 35 | 35 | 35 |
| Graininess: HG | | 28 | 31 | 25 | 38 | 28 | 27 | 26 |
| Hue angle h | | 31 | 31 | 31 | 31 | 31 | 31 | 31 |
| Chroma: C*45 | | 44 | 45 | 43 | 45 | 44 | 45 | 46 |
| Lightness: L*45 | | 17 | 18 | 16 | 19 | 17 | 18 | 19 |
| Darkness: C*45/L*45 | | 2.6 | 2.5 | 2.7 | 2.4 | 2.6 | 2.5 | 2.4 |
| Lightness in highlight: Y5 | | 126 | 123 | 129 | 123 | 126 | 123 | 120 |

| Substrate | | Example 8 Substrate 2 | Example 9 Substrate 2 | Example 10 Substrate 2 | Example 11 Substrate 2 | Example 12 Substrate 2 | Example 13 Substrate 2 | Example 14 Substrate 2 |
|---|---|---|---|---|---|---|---|---|
| Intermediate paint | Type | TP-65 No. 8110 | TP-65 No. 8110 | TP-65 No. 8110 | TP-65 No. 8110 | TP-65 No. 8110 | TP-65 No. 8110 | TP-65 No. 8110 |
| | Film thickness: μm | 30 | 30 | 30 | 30 | 30 | 30 | 30 |
| Base paint | Type | X-1 | X-1 | X-1 | X-1 | X-1 | X-1 | X-1 |
| | Film thickness: μm | 10 | 10 | 10 | 10 | 10 | 10 | 10 |
| Effect pigment dispersion | Type | Y-1 | Y-1 | Y-1 | Y-1 | Y-1 | Y-5 | Y-1 |
| | Film thickness: μm | 1.0 | 1.0 | 1.0 | 1.0 | 1.0 | 1.0 | 1.0 |
| Clear paint | Type | KINO6510 | KINO6510 | KINO6510 | KINO6510 | None | None | None |
| | Film thickness: μm | 35 | 35 | 35 | 35 | — | — | — |
| Colored transparent paint | Type | C-1 | C-2 | C-3 | C-4 | C-7 | C-7 | C-7 |
| | Film thickness: μm | 15 | 15 | 35 | 35 | 35 | 35 | 35 |
| | Light transmittance: % | 32 | 33 | 31 | 34 | 33 | 33 | 33 |
| Top clear paint | Type | KIN01210*2 | KINO6510 | KINO6510 | KINO6510 | None | None | KINO6510 |
| | Film thickness: μm | 35 | 35 | 35 | 35 | — | — | 35 |
| Graininess: HG | | 28 | 38 | 26 | 31 | 38 | 28 | 38 |
| Hue angle h | | 31 | 30 | 31 | 31 | 30 | 31 | 30 |
| Chroma: C*45 | | 44 | 44 | 45 | 43 | 44 | 38 | 44 |
| Lightness: L*45 | | 17 | 13 | 18 | 16 | 15 | 12 | 15 |
| Darkness: C*45/L*45 | | 2.6 | 3.0 | 2.5 | 2.7 | 3.0 | 3.1 | 3.0 |
| Lightness in highlight: Y5 | | 126 | 134 | 123 | 126 | 134 | 125 | 134 |

| Substrate | | Example 15 Substrate 2 | Example 16 Substrate 1 | Example 17 Substrate 1 | Example 18 Substrate 1 | Example 19 Substrate 1 | Example 20 Substrate 1 | Example 21 Substrate 1 |
|---|---|---|---|---|---|---|---|---|
| Intermediate paint | Type | TP-65 No. 8110 | WP-522H | WP-522H | WP-522H | WP-522H | WP-522H | WP-522H |
| | Film thickness: μm | 30 | 30 | 30 | 30 | 30 | 30 | 30 |
| Base paint | Type | X-1 | None | None | None | None | None | None |
| | Film thickness: μm | 10 | — | — | — | — | — | — |
| Effect pigment dispersion | Type | Y-5 | Y-1 | Y-5 | Y-1 | Y-5 | Y-1 | Y-5 |
| | Film thickness: μm | 1.0 | 1.0 | 1.0 | 1.0 | 1.0 | 1.0 | 1.0 |
| Clear paint | Type | None | KINO6510 | KINO6510 | None | None | None | None |
| | Film thickness: μm | — | 35 | 35 | — | — | — | — |
| Colored transparent paint | Type | C-7 | C-1 | C-1 | C-7 | C-7 | C-7 | C-7 |
| | Film thickness: μm | 35 | 15 | 15 | 35 | 35 | 35 | 35 |
| | Light transmittance: % | 33 | 32 | 32 | 33 | 33 | 33 | 33 |
| Top clear paint | Type | KINO6510 | KINO6510 | KINO6510 | None | None | KINO6510 | KINO6510 |
| | Film thickness: μm | 35 | 35 | 35 | — | — | 35 | 35 |
| Graininess: HG | | 28 | 28 | 27 | 38 | 28 | 38 | 28 |
| Hue angle h | | 31 | 31 | 31 | 30 | 31 | 30 | 31 |
| Chroma: C*45 | | 38 | 44 | 45 | 44 | 38 | 44 | 38 |
| Lightness: L*45 | | 12 | 17 | 18 | 15 | 12 | 15 | 12 |
| Darkness: C*45/L*45 | | 3.1 | 2.6 | 2.5 | 3.0 | 3.1 | 3.0 | 3.1 |
| Lightness in highlight: Y5 | | 125 | 126 | 123 | 134 | 125 | 134 | 125 |

TABLE 2-continued

| Substrate | | Comparative Example 1 Substrate 1 | Comparative Example 2 Substrate 1 | Comparative Example 3 Substrate 2 | Comparative Example 4 Substrate 2 | Comparative Example 5 Substrate 2 | Comparative Example 6 Substrate 2 | Comparative Example 7 Substrate 2 |
|---|---|---|---|---|---|---|---|---|
| Intermediate paint | Type | TP-65 No. 8110 | TP-65 No. 8110 | TP-65 No. 8110 | TP-65 No. 8110 | TP-65 No. 8110 | TP-65 No. 8110 | TP-65 No. 8110 |
| | Film thickness: μm | 30 | 30 | 30 | 30 | 30 | 30 | 30 |
| Base paint | Type | X-3 | X-4 | X-5 | X-1 | X-1 | X-1 | X-1 |
| | Film thickness: μm | 15 | 15 | 15 | 10 | 10 | 10 | 10 |
| Effect pigment dispersion | Type | None | None | None | Y-1 | Y-1 | Y-5 | Y-5 |
| | Film thickness: μm | — | — | — | 1.0 | 1.0 | 1.0 | 1.0 |
| Clear paint | Type | None | None | None | KINO6510 | KINO6510 | KINO6510 | KINO6510 |
| | Film thickness: μm | — | — | — | 35 | 35 | 35 | 35 |
| Colored transparent paint | Type | C-7 | C-1 | None | C-5 | C-6 | C-5 | C-6 |
| | Film thickness: μm | 35 | 10 | — | 15 | 15 | 15 | 15 |
| | Light transmittance: % | 33 | 31.7 | — | 19 | 71 | 19 | 71 |
| Top clear paint | Type | None | KINO6510 | KINO6510 | KINO6510 | KINO6510 | KINO6510 | KINO6510 |
| | Film thickness: μm | — | 35 | 35 | 35 | 35 | 35 | 35 |
| Graininess: HG | | 26 | 65 | 50 | 25 | 46 | 23 | 44 |
| Hue angle h | | 32 | 33 | 34 | 27 | 31 | 34 | 32 |
| Chroma: C*45 | | 49 | 51 | 52 | 40 | 38 | 43 | 40 |
| Lightness: L*45 | | 17 | 21 | 23 | 12 | 20 | 11 | 14 |
| Darkness: C*45/L*45 | | 2.3 | 2.3 | 2.3 | 3.4 | 1.9 | 3.9 | 2.9 |
| Lightness in highlight: Y5 | | 95 | 61 | 43 | 47 | 360 | 35 | 123 |

*1 Substrate 2 was obtained by applying "78-65 No. 8110" (trade name, produced by Kansai Paint Co., Ltd., a polyester resin-based solvent-based intermediate paint, $L_i^*$ value of the coating film to be obtained: 20), and bake-drying.
*2 "KINO#1210TW" (trade name, produced by Kansai Paint Co., Ltd., an acid epoxy curing-type acrylic resin-based clear paint)

Example 12

The transparent base paint (X-1) was applied to the substrate 2 to a film thickness of 10 μm when cured using a rotary atomization electrostatic coating device, and allowed to stand for 3 minutes to form an uncured base coating film.

Subsequently, the effect pigment dispersion (Y-1) prepared as described above was applied to the obtained uncured base coating film to a dry film thickness of 1.0 μm using a robot bell (produced by ABB) at a booth temperature of 23° C. and at a humidity of 68%; allowed to stand for 3 minutes; and then allowed to stand at 80° C. for 3 minutes, thereby forming an uncured effect pigment-containing coating film.

Further, the colored transparent paint (C-7: color clear paint) was applied to the uncured effect pigment-containing coating film to a dry film thickness of 35 μm using a robot bell (produced by ABB) at a booth temperature of 23° C. and at a humidity of 68% to form a colored transparent coating film. After coating, the resultant was allowed to stand at room temperature for 7 minutes. After heating in a hot-air circulation-type dryer at 140° C. for 30 minutes to simultaneously dry the three coating films, a multilayer coating film was formed, thereby preparing a test plate.

Example 13

A multilayer coating film was formed, thereby preparing a test plate in the same manner as in Example 12, except that the coating-film structure shown in Table 2 was adopted.

Example 14

The transparent base paint (X-1) was applied to the substrate 2 to a film thickness of 10 μm when cured using a rotary atomization electrostatic coating device, and allowed to stand for 3 minutes to form an uncured base coating film.

Subsequently, the effect pigment dispersion (Y-1) prepared as described above was applied to the obtained uncured base coating film to a dry film thickness of 1.0 μm using a robot bell (produced by ABB) at a booth temperature of 23° C. and at a humidity of 68%; allowed to stand for 3 minutes; and then allowed to stand at 80° C. for 3 minutes, thereby forming an uncured effect pigment-containing coating film.

Further, the colored transparent paint (C-7: color clear paint) was applied to the uncured effect pigment-containing coating film to a dry film thickness of 35 μm using a robot bell (produced by ABB) at a booth temperature of 23° C. and at a humidity of 68% to form an uncured colored transparent coating film. After coating, the resultant was allowed to stand at room temperature for 7 minutes. After heating in a hot-air circulation-type dryer at 140° C. for 30 minutes to simultaneously dry the three coating films, a multilayer coating film was formed.

Subsequently, "KINO6510" clear paint (Z-1) (trade name, produced by Kansai Paint Co., Ltd., a hydroxy/isocyanate curable acrylic resin and urethane resin-based two-component organic solvent-based paint) was applied to the multilayer coating film to a dry film thickness of 35 μm using a robot bell (produced by ABB) at a booth temperature of 23° C. and at a humidity of 68% to form an uncured clear coating film. After coating, the resultant was allowed to stand at room temperature for 7 minutes. After heating in a hot-air circulation-type dryer at 140° C. for 30 minutes to dry the uncured clear coating film, a multilayer coating m was formed, thereby preparing a test plate.

Example 15

A multilayer coating film was formed, thereby preparing a test plate in the same manner as in Example 14, except that the coating-film structure shown in Table 2 was adopted.

Example 16

"WP-522H N-2.0" intermediate paint (trade name, produced by Kansai Paint Co., Ltd., a polyester resin-based aqueous intermediate paint, L* value of the coating film to be obtained: 20) was applied to the substrate 1 to a cured film thickness of 30 μm by electrostatic spraying using a rotary atomization-type bell-shaped coating device, and allowed to stand for 3 minutes. Thereafter, the resultant was preheated at 80° C. for 3 minutes to form an uncured intermediate coating film.

Further, the effect pigment dispersion (Y-1) prepared as described above was applied to the obtained uncured intermediate coating film to a dry film thickness of 1.0 μm using a robot bell (produced by ABB) at a booth temperature of 23° C. and at a humidity of 68%; allowed to stand for 3 minutes; and then allowed to stand at 80° C. for 3 minutes, thereby forming an uncured effect pigment-containing coating film.

Subsequently, "KINO6510" clear paint (Z-1) (trade name, produced by Kansai Paint Co., Ltd., a hydroxy/isocyanate curable acrylic resin and urethane resin-based two-component organic solvent-based paint) was applied to the uncured effect pigment-containing coating film to a dry film thickness of 35 μm using a robot bell (produced by ABB) at a booth temperature of 23° C. and at a humidity of 68% to form a clear coating film. After coating, the resultant was allowed to stand at room temperature for 7 minutes, After heating in a hot-air circulation-type dryer at 140° C. for 30 minutes to simultaneously dry the three coating films, a multilayer coating film was formed.

Subsequently, the colored transparent paint (C-1) was applied to the multilayer coating film to a film thickness of 15 μm when cured using a rotary atomization electrostatic coating device, and allowed to stand for 3 minutes. Thereafter, the resultant was preheated at 80° C. for 3 minutes to form an uncured colored transparent coating film.

Further, "KINO6510" clear paint (Z-1) (trade name, produced by Kansai Paint Co., Ltd., a hydroxy/isocyanate curable acrylic resin and urethane resin-based two-component organic solvent-based paint) was applied to the obtained uncured colored transparent Coating film to a dry film thickness of 35 μm using a robot bell (produced by ABB) at a booth temperature of 23° C. and at a humidity of 68% to form a clear coating film. After coating, the resultant was allowed to stand at room temperature for 7 minutes. After heating in a hot-air circulation-type dryer at 140° C. for 30 minutes to simultaneously dry the three coating films, a multilayer coating film was formed, thereby preparing a test plate.

Example 17

A multilayer coating film was formed, thereby preparing a test plate in the same manner as in Example 16, except that the coating-film structure shown in Table 2 was adopted.

Example 18

"WP-522H N-2.0" intermediate paint. (trade name, produced by Kansai Paint Co., Ltd., a polyester resin-based aqueous intermediate paint, L* value of the coating film to be obtained: 20) was applied to the substrate 1 to a cured film thickness of 30 μm by electrostatic spraying using a rotary atomization-type bell-shaped coating device, and allowed to stand for 3 minutes. Thereafter, the resultant was preheated at 80° C. for 3 minutes to form an uncured intermediate coating film.

Subsequently, the effect pigment dispersion (Y-1) prepared as described above was applied to the obtained uncured intermediate coating film to a dry film thickness of 1.0 μm using a robot bell (produced by ABB) at a booth temperature of 23° C. and at a humidity of 68%; allowed to stand for 3 minutes; and then allowed to stand at 80° C. for 3 minutes, thereby forming an uncured effect pigment-containing coating film.

Further, the colored transparent paint (C-7: color clear paint) was applied to the uncured effect pigment-containing coating film to a dry film thickness of 35 μm using a robot bell (produced by ABB) at a booth temperature of 23° C. and at a humidity of 68% to form a colored transparent coating film. After coating, the resultant was allowed to stand at room temperature for 7 minutes. After heating in a hot-air circulation-type dryer at 140° C. for 30 minutes to simultaneously dry the three coating films, a multilayer coating film was formed, thereby preparing a test plate.

Example 19

A multilayer coating film was formed, thereby preparing a test plate in the same manner as in Example 18, except that the coating-film structure shown in Table 2 was adopted.

Example 20

"WP-522H N-2.0" intermediate paint (trade name, produced by Kansai Paint Co., Ltd., a polyester resin-based aqueous intermediate paint, L* value of the coating film to be obtained: 20) was applied to the substrate 1 to a cured film thickness of 30 μm by electrostatic spraying using a rotary atomization-type bell-shaped coating device, and allowed to stand for 3 minutes. Thereafter, the resultant was preheated at 80° C. for 3 minutes to form an uncured intermediate coating film.

Subsequently, the effect pigment dispersion (Y-1) prepared as described above was applied to the obtained uncured intermediate coating film to a dry film thickness of 1.0 μm using a robot bell (produced by ABB) at a booth temperature of 23° C. and at a humidity of 68%; allowed to stand for 3 minutes; and then allowed to stand at 80° C. for 3 minutes, thereby forming an uncured effect pigment-containing coating film.

Further, the colored transparent paint (C-7: color clear paint) was applied to the uncured effect pigment-containing coating film to a dry film thickness of 35 μm using a robot bell (produced by ABB) at a booth temperature of 23° C. and at a humidity of 68% to form a colored transparent coating film. After coating, the resultant was allowed to stand at room temperature for 7 minutes. After heating in a hot-air circulation-type dryer at 140° C. for 30 minutes to simultaneously dry the three coating films, a multilayer coating film was formed.

Subsequently, "KINO6510" clear paint (Z-1) (trade name, produced by Kansai Paint Co., Ltd., a hydroxy/isocyanate curable acrylic resin and urethane resin-based two-component organic solvent-based paint) was applied to the multilayer coating film to a dry film thickness of 35 μm using a robot bell (produced by ABB) at a booth temperature of 23°

C. and at a humidity of 68% to form an uncured clear coating film. After coating, the resultant was allowed to stand at room temperature for 7 minutes. After heating in a hot-air circulation-type dryer at 140° C. for 30 minutes to simultaneously dry the uncured clear coating film, a multilayer coating film was formed, thereby preparing a test plate.

Example 21

A multilayer coating film was formed, thereby preparing a test plate in the same manner as in Example 20, except that the coating-film structure shown in Table 2 was adopted.

Comparative Example 1

The metallic base paint 1 (X-3) was applied to the substrate 2 to a film thickness of 15 μm when cured using a rotary atomization electrostatic coating device, and allowed to stand for 3 minutes. Thereafter, the resultant was preheated at 80° C. for 3 minutes to form an uncured metallic base coating film.

Further, the colored transparent paint (C-7: color clear paint) was applied to the uncured metallic base coating film to a dry film thickness of 35 μm using a robot bell (produced by ABB) at a booth temperature of 23° C. and at a humidity of 68% to form a colored transparent coating film. After coating, the resultant was allowed to stand at room temperature for 7 minutes. After heating in a hot-air circulation-type dryer at 140° C. for 30 minutes to simultaneously dry the two coating films, a multilayer coating film was formed, thereby preparing a test plate.

Comparative Example 2

The metallic base paint 2 (X-4) was applied to the substrate 2 to a film thickness of 15 μm when cured using a rotary atomization electrostatic coating device, and allowed to stand for 3 minutes. Thereafter, the resultant was preheated at 80° C. for 3 minutes to form an uncured metallic base coating film.

The colored transparent paint (C-1) was applied to the uncured metallic base coating film to a film thickness of 6 μm when cured using a rotary atomization electrostatic coating device, and allowed to stand for 3 minutes. Thereafter, the resultant was preheated at 80° C. for 3 minutes to form an uncured colored transparent coating film.

Further, "KINO6510" clear paint (Z-1) (trade name, produced by Kansai Paint Co., Ltd., a hydroxy/isocyanate curable acrylic resin and urethane resin-based two-component organic solvent-based paint) was applied to the obtained uncured colored transparent coating film to a dry film thickness of 35 μm using a robot bell (produced by ABB) at a booth temperature of 23° C. and at a humidity of 68% to form a clear coating film. After coating, the resultant was allowed to stand at room temperature for 7 minutes. After heating in a hot-air circulation-type dryer at 140° C. for 30 minutes to simultaneously dry the three coating films, a multilayer coating film was formed, thereby preparing a test plate.

Comparative Example 3

The metallic base paint 3 (X-5) was applied to the substrate 1 to a film thickness of 15 μm when cured using a rotary atomization electrostatic coating device, and allowed to stand for 3 minutes. Thereafter, the resultant was preheated at 80° C. for 3 minutes to form an uncured metallic base coating film.

Further, "KINO6510" clear paint (Z-1) (trade name, produced by Kansai Paint Co., Ltd., a hydroxy/isocyanate curable acrylic resin and urethane resin-based two-component organic solvent-based paint) was applied to the uncured metallic base coating film to a dry film thickness of 35 μm using a robot bell (produced by ABB) at a booth temperature of 23° C. and at a humidity of 68% to form an uncured clear coating film. After coating, the resultant was allowed to stand at room temperature for 7 minutes. After heating in a hot-air circulation-type dryer at 140° C. for 30 minutes to simultaneously dry the two coating films, a multilayer coating film was formed, thereby preparing a test plate.

Light Transmittance of Colored Transparent Coating Film

Regarding the Examples and Comparative Examples that comprise the step of forming a colored transparent coating film, the colored transparent paint was also applied to a smooth OHP sheet that had been degreased with a solvent beforehand, in addition to the surface to be coated described in the Examples and Comparative Examples, in the step of forming a colored transparent coating film. Without performing film formation in the next step in the Examples and Comparative Examples, the OHP sheet with the uncured colored transparent coating film formed thereon was allowed to stand for 3 minutes, preheated at 80° C. for 3 minutes, and then heated in a hot-air circulation-type dryer at 140° C. for 30 minutes to form a cured colored transparent coating film on the OHP sheet.

The light transmittance of the obtained colored transparent coating film at a wavelength of 400 to 700 nm was measured using an "MPS-2450" spectrophotometer (trade name, produced by Shimadzu Corporation). Table 2 shows the results.

Evaluation of Coating Film

The appearance and performance of each test plate obtained in the above manner were evaluated. Table 2 shows the results.

(1) Graininess

Table 2 shows the hi-light graininess value (hereinafter "HG value") as the graininess. The HG value is a parameter of microscopic brilliance, which is a texture obtained by microscopic observation, and indicates the graininess in the highlight (when the coating film was observed from near specular reflection with respect to the incident light). The HG value was obtained by photographing the coating film at an incident angle of 45° and a receiving angle of 0° using a CCD camera; subjecting the obtained digital image data (i.e., two-dimensional brilliance distribution data) to two-dimensional Fourier transformation; extracting only the spatial frequency area corresponding to graininess from the obtained power spectrum image; and converting the obtained measurement parameter into a numerical value in the range of 0 to 100 that has a linear relation with graininess.

(2) Hue angle h

Table 2 shows the hue angle h in the L*C*h color space diagram calculated based on the spectral reflectance of light illuminated at an angle of 45 degrees with respect to the coating film, and received at an angle of 15 degrees deviated from the specular reflection light. For the measurement, a multi-angle spectrophotometer (produced by X-Rite Inc., trade name: MA-68II) was used.

(3) Chroma C*45

Table 2 shows the chroma C*45 in the L*C*h* color space calculated based on the spectral reflectance of light illuminated at an angle of 45 degrees with respect to the coating film, and received at an angle of 45 degrees deviated from the specular reflection light. For the measurement, a multi-angle spectrophotometer (produced by X-Rite Inc., trade name: MA-68II) was used.

(4) Lightness L*45

Table 2 shows the lightness L*45 in the L*a*b* color space calculated based on the spectral reflectance of light illuminated at an angle of 45 degrees with respect to the coating film, and received at an angle of 45 degrees deviated from the specular reflection light. For the measurement, a multi-angle spectrophotometer (produced by X-Rite Inc., trade name: MA-68II) was used.

(5) Index of Depth-Feeling: C*45/L*45

Table 2 shows the index of depth-feeling C*45/L*45 obtained by dividing the chroma C*45 by lightness L*45 in the L*C*h* color space calculated based on the spectral reflectance of light illuminated at an angle of 45 degrees with respect to the coating film, and received at an angle of 45 degrees deviated from the specular reflection light. For the measurement, a multi-angle spectrophotometer (produced by X-Rite Inc., trade name MA-68II) was used.

(6) Lightness Y5 in Highlight

Table 2 shows the brightness Y (Y5) in the XYZ color space calculated based on the spectral reflectance of light illuminated at an angle of 45 degrees with respect to the coating film, and received at an angle of 5 degrees deviated from the specular reflection light. For the measurement, a multi-angle spectrophotometer (produced by X-Rite Inc., trade name: MA-68II) was used.

(7) Flip-Flop

When the brightness Y5 was high and the lightness L*45 was low, the flip-flop property was evaluated as high.

The invention claimed is:

1. A method for forming a multilayer coating film comprising the steps of:

applying, to a substrate, an effect pigment dispersion that comprises water, a surface adjusting agent, a flake-effect pigment, and a rheology control agent, and that has a solids content within the range of 0.5 to 10 mass % to form an effect pigment-containing coating film; and applying a colored transparent paint to the effect pigment-containing coating film to form a colored transparent coating film having a total light transmittance at a wavelength of 400 nm to 700 nm of 20 to 70%, wherein the rheology control agent in the effect pigment dispersion is a cellulose nanofiber.

2. The method for forming a multilayer coating film according to claim 1, further comprising a step of applying a top clear paint to the colored transparent coating film to form a top clear coating film.

3. The method for forming a multilayer coating film according to claim 1, wherein the flake-effect pigment in the effect pigment dispersion is a vapor deposition metal flake pigment.

4. The method for forming a multilayer coating film according to claim 1, wherein the effect pigment dispersion further comprises a color pigment.

* * * * *